US005805049A

United States Patent [19]

Yamada et al.

[11] Patent Number: 5,805,049

[45] Date of Patent: Sep. 8, 1998

[54] TEMPERATURE-MEASURING-RESISTOR, MANUFACTURING METHOD THEREFOR, RAY DETECTING ELEMENT USING THE SAME

[75] Inventors: Akira Yamada; Takehiko Sato; Toshihisa Honda; Toshio Umemura; Fusaoki Uchikawa, all of Tokyo, Japan

[73] Assignee: Mitsubishi Denki Kabushiki Kaisha, Tokyo, Japan

[21] Appl. No.: 657,191

[22] Filed: Jun. 3, 1996

[30] Foreign Application Priority Data

Jun. 14, 1995 [JP] Japan ..... 7-147559
Apr. 5, 1996 [JP] Japan ..... 8-083823

[51] Int. Cl.[6] ..... H01C 3/04

[52] U.S. Cl. ..... 338/25; 338/22 SD; 338/22 R

[58] Field of Search ..... 338/22 SD, 22 R, 338/25, 32 R, 35, 34, 92, 7, 8, 9; 254/506, 507, 508, 509

[56] References Cited

U.S. PATENT DOCUMENTS 3,899,407 8/1975 Eastwood et al. ..... 204/192
3,932,312 1/1976 Kazmierowicz ..... 252/518
4,007,435 2/1977 Tien ..... 338/34
4,020,443 4/1977 Leroy et al. ..... 338/28
4,068,281 1/1978 Harnden, Jr. ..... 361/106
4,562,057 12/1985 Goddard et al. ..... 423/409
4,647,895 3/1987 Howng ..... 338/22 R
4,743,881 5/1988 Howng ..... 338/25

FOREIGN PATENT DOCUMENTS 995130 2/1983 U.S.S.R. .

OTHER PUBLICATIONS $V_2O_3$ based PTC Resistor with High Electrical Conductivity, Technical Research Report No. CPM86–28, Telecommunication Academic Society, Jul. 28, 1986, pp. 21–26.

*Primary Examiner*—Adolf Berhane
*Attorney, Agent, or Firm*—Burns, Doane, Swecker & Mathis, LLP

[57] ABSTRACT

The invention relates to a temperature-measuring-resistor which comprises vanadium oxide as a matrix material. The matrix material further contains at least one member selected from a metal, a metal oxide and a metal nitride, and the member has an electric conductivity higher than that of the vanadium oxide. The temperature-measuring-resistor has a low room temperature resistivity, and a volume resisivity that varies greatly with temperature.

22 Claims, 8 Drawing Sheets

FIG. 1(a)
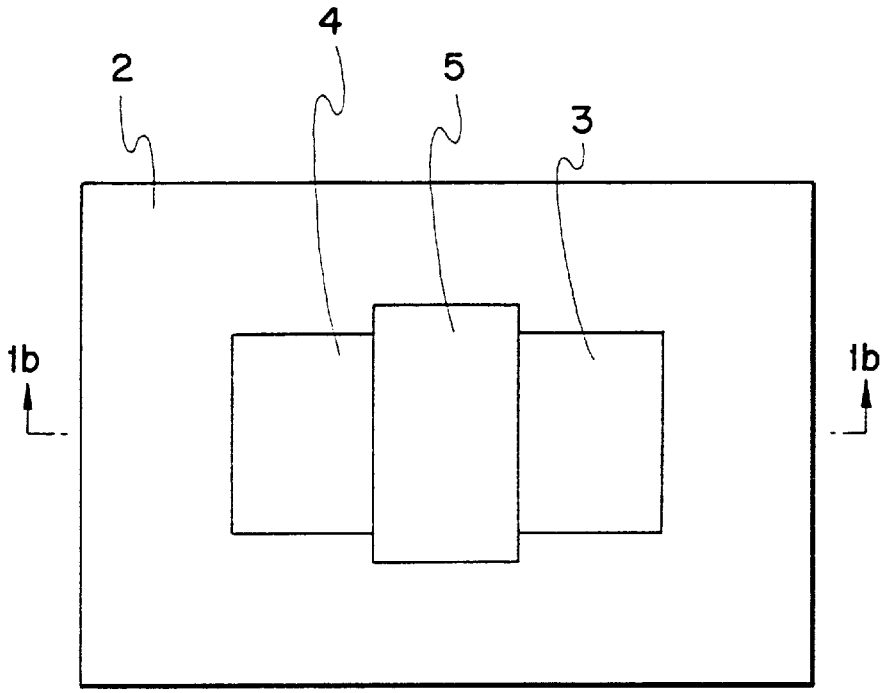
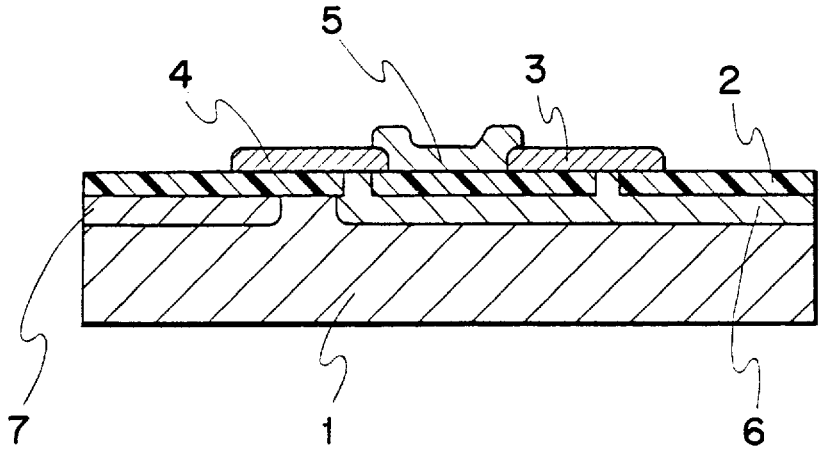
FIG. 1(b)

FIG. 2(a)
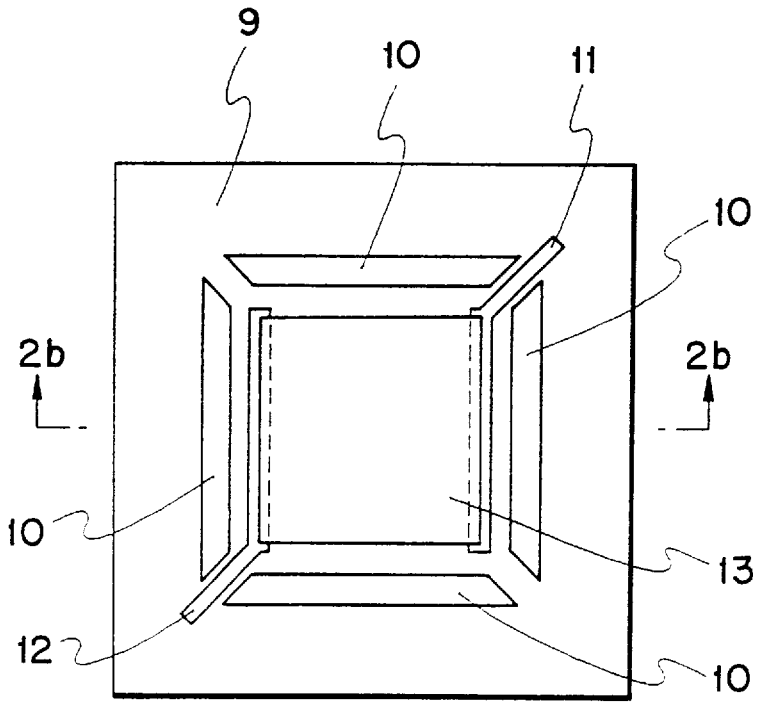
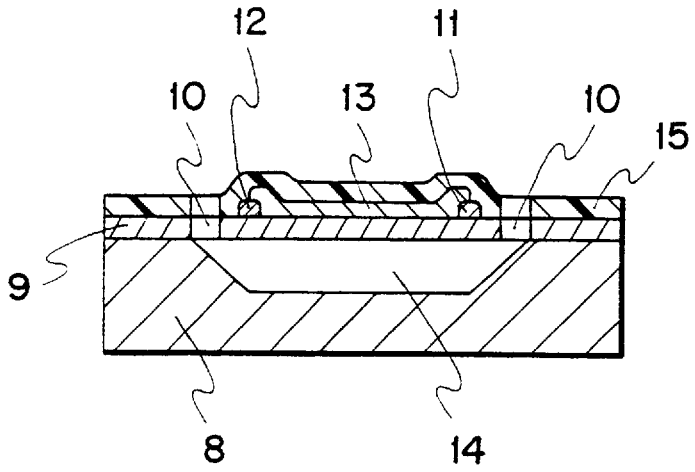
FIG. 2(b)

FIG. 3(a)
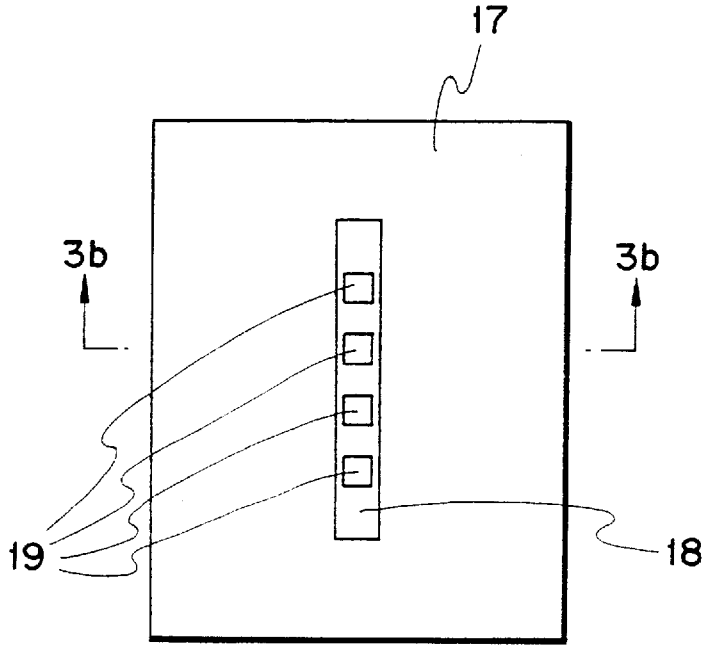
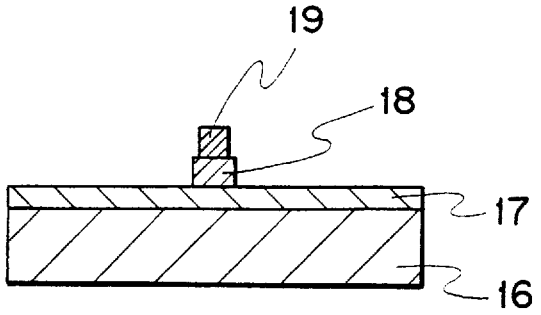
FIG. 3(b)

FIG. 5(a)
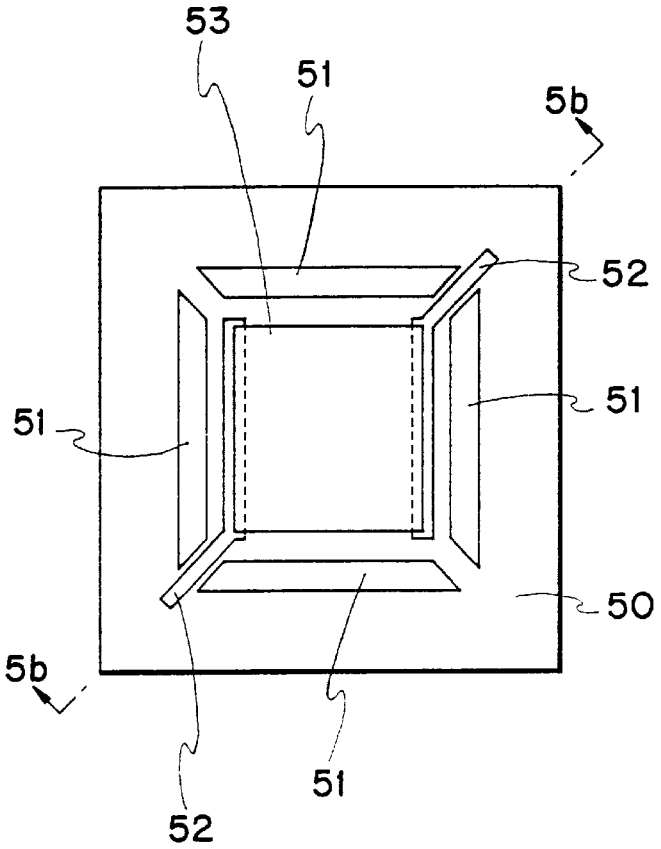
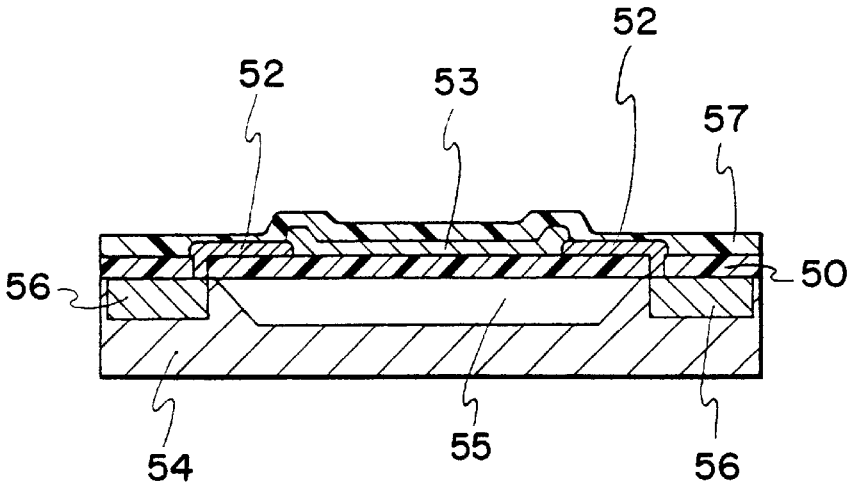
FIG. 5(b)

FIG. 7(a)
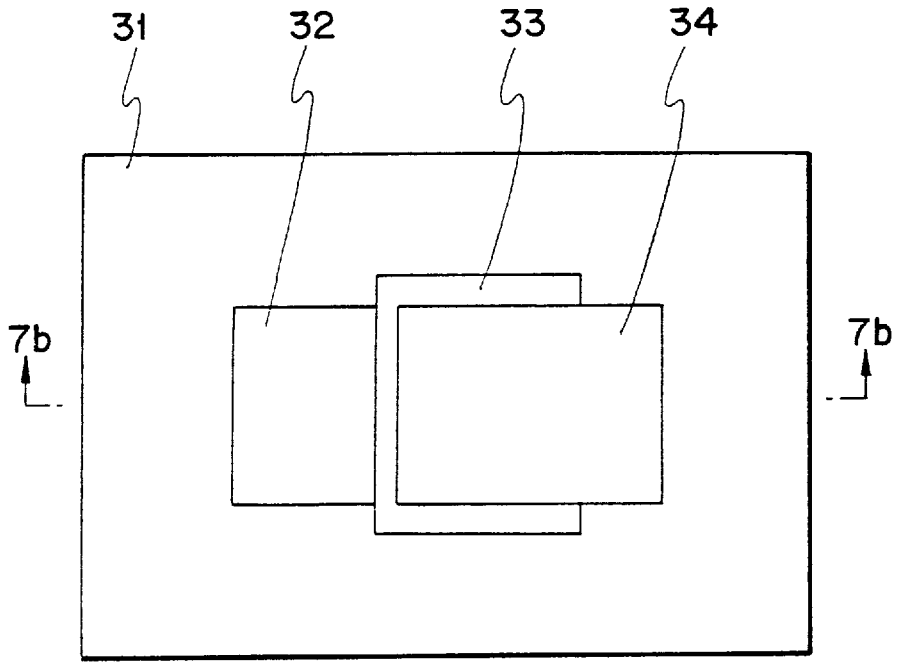
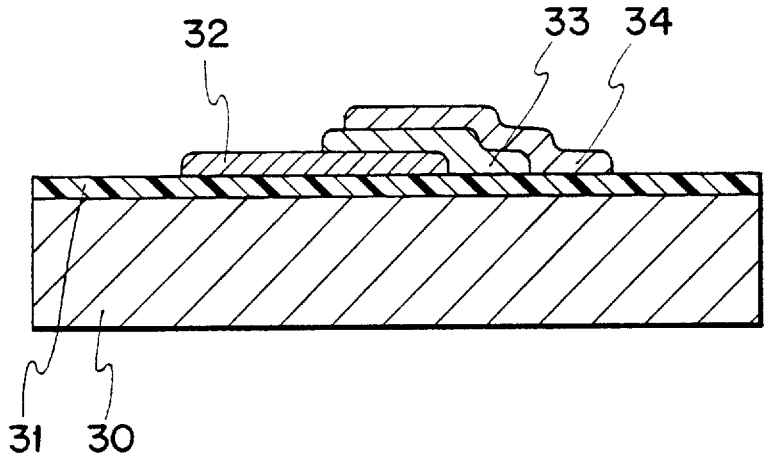
FIG. 7(b)

TEMPERATURE-MEASURING-RESISTOR, MANUFACTURING METHOD THEREFOR, RAY DETECTING ELEMENT USING THE SAME

BACKGROUND OF THE INVENTION

The present invention relates to a highly precise electric resistor for temperature measuring (hereinafter referred to as "temperature-measuring-resistor") which can be highly integrated and is highly sensitive, a method of manufacturing the temperature-measuring-resistor, and various elements using it. Specifically, the present invention relates to a temperature-measuring-resistor, wherein its volume resistivity at around room temperature is lower than that of a conventional temperature-measuring-resistor. Thus, a large amount of self-heat generation is avoided when electric current is turned on at around room temperature even in the case of a temperature-measuring-resistor being highly integrated or made thin. The temperature-measuring-resistor is very precise and sensitive because of such properties as less self-heat generation and a large variation of volume resistivity with its temperature change. The invention also relates to a method of manufacturing the temperature-measuring-resistor.

Further, the present invention relates to an infrared-ray detecting element using the above-mentioned temperature-measuring resistor.

With the advance of downsizing and the progress of performance of electronic devices, it is required for thermosensors to be superdownsized, highly sensitive, highly accurate, and highly integrated. Heretofore, to satisfy these requirements, various attempts have been made, and as one of them, there is a known conventional method wherein a layer of a temperature-measuring-resistor, which is a material of the temperature sensor, is made thin to construct a temperature measuring device. In order to manufacture the temperature measuring device by the conventional method, there is required a temperature-measuring-resistor which has a desired low volume resistivity at room temperature and can show a large variation of the volume resistivity with its temperature change to increase compatibility between the temperature measuring device and the external circuit thereof. Also, it is necessary that such a temperature-measuring-resistor can be manufactured easily.

However, there is no conventional temperature-measuring-resistor which satisfies all the above-mentioned characteristic requirements.

For example, though a metal-type temperature-measuring-resistor has a sufficiently low volume resistivity, the rate of variation of the volume resistivity (hereinafter referred to as "TCR: Temperature Coefficient of Resistivity") is low, i.e. less than 0.7%/K at most, which is insufficient.

Two examples of the temperature-measuring-resistors which have a relatively low volume resistivity and a large TCR are as mentioned below.

One example is a group of oxide semiconductors so-called NTC thermistor, which is widely used for temperature measuring. The volume resistivities of these oxide semiconductors can vary relatively greatly with their temperature change in a wide temperature range. However, similar to usual resistors, generally even in these temperature-measuring-resistors, there is a tendency such that in case of their volume resistivities being high, they show a relatively large TCR with their temperature change, but the lower the volume resistivities of the temperature-measuring-resistor are, the smaller the TCR is as described in the first edition of Ceramic Engineering Handbook (1989, published by Japan Ceramic Society, printed by Gihodo Shuppan, page 1834). For example, in case of a temperature-measuring-resistor having a volume resistivity of 200 to 300 mΩ·cm or lower at 27° C. (300 K), the TCR is being in the range of 0.2 to 0.3%/K, which is equivalent to that of the metal-type temperature-measuring-resistor.

Namely the conventional NTC thermistors have a problem that it is difficult to make their volume resistivity lower and their TCR large.

Another example is oxide semiconductors so-called CTR thermistor or PTC thermistor, which is also widely used for temperature measuring. These CTR and PTC thermistors have two temperature regions respectively, that is, in one region, these thermistors have a good electric conductivity, and in another region, they have a high volume resistivity. These thermistors have a transition point at which the volume resistivity greatly varies (hereinafter may be referred to as "transition point").

These types of thermistors are described in the specification of U.S. Pat. No. 3,899,407 (Eastwood et al) and in the technical research report CPM86-28 (Yoshino et al) of Telecommunication Academic Society. The patent specification described above discloses a vanadium type composite metal oxide obtainable through a reactive sputtering method by using a vapor-deposition source prepared by incorporating a specific metal into a vanadium metal in 0.05 to 10 atomic % under oxygen gas atmosphere. And, it is also disclosed in that patent specification that the above-mentioned transition point of the composite metal oxide can be controlled at a proper temperature in the range of 50° to 100° C. Also, the above-mentioned technical report discloses that a vanadium-type composite metal oxide is obtainable by sintering a mixture of $(V,Cr)_2O_3$ and tin oxide, iron oxide or the like, and that the sintered composite metal oxide has a low volume resistivity in the highly electrically conductive temperature region. However, these CTR and PTC thermistors are not yet satisfactory from the viewpoints of volume resistivity and TCR.

Typical example of the conventional PTC thermistors is a barium-titanate-type thermistor. However, there is a problem that in case where that type of thermistor is made thin like a film or its size is made small, it is difficult to use the thermistor for temperature measuring elements and devices having a highly precise sensitivity since the volume resistivity becomes high even in the highly electrically conductive temperature region.

The CTR thermistor disclosed in the above-mentioned patent specification has a volume resistivity nearly equal to that of a thin film of the sintered vanadium oxide which is a typical conventional CTR thermistor, and can realize an exponential change in volume resistivity with temperature change, and also makes it possible to control the transition point at a proper temperature by adjusting a mixing ratio of the vapor-deposition sources. The CTR, however, has a problem that the volume resistivity at around room temperature is high. The above-mentioned technical research report relates to the thermistor of vanadium-oxide-type thin layer having properties of the PTC thermistor. Though such a thermistor shows a low volume resistivity nearly equal to that of metals at around room temperature, it is difficult to apply to a temperature-measuring-resistor since its TCR is small and it has a transition point of the volume resistivity at around room temperature.

An object of the present invention is to provide a temperature-measuring-resistor which can assure downsizing, high integration, high accuracy, and high sensitivity of the temperature measuring element, and a method of manufacturing thereof. That is, an object of the present invention is to provide a temperature-measuring-resistor having a volume resistivity of not more than 20 mΩ·m at room temperature and a TCR of not less than that of a usual metal-type resistor, namely an absolute value of the TCR of not less than around 0.7%/K, and having no transition point of the volume resistivity in a temperature range of −20° to 80° C., and a method of manufacturing thereof.

Another object of the present invention is to provide a temperature measuring element or a temperature measuring device using the temperature-measuring-resistor on its temperature measuring portion.

Still another object of the present invention is to provide an infrared-ray detecting element or an infrared-ray detecting device using the above-mentioned temperature-measuring-resistor.

SUMMARY OF THE INVENTION

The present invention relates to a temperature-measuring-resistor comprising vanadium oxide as a matrix material, wherein the matrix material contains at least one member selected from the group consisting of a metal, a metal oxide and a metal nitride and the above-mentioned member has an electric conductivity higher than that of the vanadium oxide.

It is preferable that the above-mentioned metal comprises at least one metal selected from the group consisting of platinum, iridium and rhodium.

Further, it is preferable that the above-mentioned metal oxide comprises at least one metal oxide selected from the group consisting of a ruthenium oxide, a platinum oxide, an iridium oxide and a rhodium oxide.

Also, it is preferable that the above-mentioned metal nitride comprises at least one metal nitride selected from the group consisting of a titanium nitride, a niobium nitride and a tantalum nitride.

Further, it is preferable that the number of metal atoms derived from the electrically conductive material is in the range of 5 to 70% of the total number of metal atoms in the temperature-measuring-resistor.

Also, it is preferable that the above-mentioned metal nitride comprises a vanadium nitride.

Also, it is preferable that, assuming that a ratio of the number of nitrogen atoms to the sum of nitrogen atoms and oxygen atoms in the above-mentioned vanadium oxide which contains the vanadium nitride is represented by X, the ratio X is in the range shown by the equation: $0<X\leqq 0.67$.

The present invention also relates to a method of manufacturing a temperature-measuring-resistor comprising vanadium oxide as a matrix material, wherein the matrix material contains at least one member selected from the group consisting of a metal, a metal oxide and a metal nitride and such a member has an electric conductivity higher than that of the vanadium oxide; and the method comprises a step of vapor-deposition under a gas atmosphere by using, as vapor-deposition sources, a first material for forming the vanadium oxide and a second material for forming at least one member selected from the group consisting of the metal, the metal oxide and the metal nitride.

It is preferable that in the above-mentioned manufacturing method, the first material is vanadium oxide, the second material is a metal and/or metal oxide, the gas atmosphere is an inert gas atmosphere and the vapor-deposition is physical vapor-deposition.

Also, it is preferable that the first material is vanadium oxide, the second material is a metal and/or metal nitride, the gas atmosphere is a gas atmosphere containing a nitriding gas and the vapor-deposition is reactive physical vapor-deposition.

The present invention also relates to a temperature-measuring-resistor comprising a vanadium compound which contains vanadium, oxygen and nitrogen.

It is preferable that, assuming that a ratio of the number of nitrogen atoms to the sum of nitrogen atoms and oxygen atoms in the above-mentioned vanadium compound is represented by Y, the ratio Y is in the range shown by the equation: $0<Y\leqq 0.52$.

Further, it is preferable that the average valency of vanadium atoms in the above-mentioned vanadium compound is in the range of 4.2 to 4.9.

Also, it is preferable that the above-mentioned vanadium compound contains at least one member being selected from the group consisting of a metal, a metal oxide and a metal nitride and having an electric conductivity higher than that of the vanadium compound.

The present invention also relates to a method of manufacturing a temperature-measuring-resistor comprising a vanadium compound which contains vanadium, oxygen and nitrogen, wherein the method comprises a step of reactive physical vapor-deposition under a gas atmosphere which contains a nitriding gas and may contain an oxidizing gas by using, as a vapor-deposition source, a material containing at least one of vanadium or vanadium oxide.

It is preferable, in the above-mentioned manufacturing method, to anneal the vanadium compound containing vanadium, oxygen and nitrogen in an oxidizing gas atmosphere.

The present invention also relates to an infrared-ray detecting element which comprises an insulative support film, a pair of electrodes formed thereon and a temperature-measuring-resistor connected to the electrodes, and the temperature-measuring-resistor comprises vanadium oxide as a matrix material, wherein the matrix material contains at least one member being selected from the group consisting of a metal, a metal oxide and a metal nitride and having an electric conductivity higher than that of the vanadium oxide.

It is preferable that a pair of electrodes comprises a material comprising vanadium oxide as a matrix material, wherein the matrix material contains at least one member being selected from the group consisting of the metal, the metal oxide and the metal nitride and having an electric conductivity higher than that of the vanadium oxide.

The present invention also relates to an infrared-ray detecting element which comprises an insulative support film, a pair of electrodes formed thereon and a temperature-measuring-resistor connected to the electrodes, and the temperature-measuring-resistor comprises a vanadium compound containing vanadium, oxygen and nitrogen.

It is preferable that a pair of the above-mentioned electrodes comprises a vanadium compound containing vanadium, oxygen and nitrogen.

Also it is preferable that, assuming that a ratio of the number of nitrogen atoms to the sum of oxygen atoms and nitrogen atoms in the above-mentioned vanadium compound is represented by Y, the ratio Y is in the range shown by the equation $0<Y\leqq 0.52$.

Also, it is preferable that the average valency of vanadium atoms in the above-mentioned vanadium compound is in the range of 4.2 to 4.9.

BRIEF DESCRIPTION OF THE DRAWINGS

FIG. 1(*a*) is a plan view showing one embodiment of the temperature measuring element of Example 1 and FIG. 1(*b*) is a cross-sectional view of a line A—A of FIG. 1(*a*).

FIG. 2(*a*) is a plan view showing one embodiment of the infrared-ray detecting device of the present invention and FIG. 2(*b*) is a cross-sectional view of a line B—B of FIG. 2(*a*).

FIG. 3(*a*) is a plan view showing an apparatus for measuring volume resistivity of the temperature-measuring-resistor and its TCR and FIG. 3(*b*) is a cross-sectional view of a line C—C of FIG. 3(*a*).

FIG. 5(*a*) is a plan view showing an infrared-ray detecting element of Example 12 and FIG. 5(*b*) is a cross-sectional view of a line E—E of FIG. 5(*a*).

FIG. 7(*a*) is a plan view showing a construction of a conventional temperature measuring element and FIG. 7(*b*) is a cross-sectional view of a line D—D of FIG. 7(*a*).

DETAILED DESCRIPTION

The temperature-measuring-resistor of the present invention has the feature that its volume resistivity varies greatly with temperature change as compared with the conventional temperature-measuring-resistor while its volume resistivity is low at room temperature.

The temperature-measuring-resistor mentioned above is classified into two types, i.e. (1) the temperature-measuring-resistor comprising vanadium oxide as a matrix material wherein the matrix material contains at least one member selected from the group consisting of a metal, a metal oxide and a metal nitride and the above-mentioned member has electric conductivity higher than that of the vanadium oxide (hereinafter may be referred to as "temperature-measuring-resistor (1)") and (2) the temperature-measuring-resistor comprising a vanadium compound containing vanadium, oxygen and nitrogen (hereinafter may be referred to as "temperature-measuring-resistor (2)").

Generally, a temperature-measuring-resistor is semiconductive. In case where a temperature-measuring-resistor has no transition point in volume resistivity, which is developed due to phase transition and the like, a relation of a logarithm of the volume resistivity (log ρ) with an inverse number of the absolute temperature (1/T) is almost linear, and this relation can be represented by the equation:

$$\rho=\rho\infty\exp(B/T) \quad \text{(I)}$$

Also, in case of a temperature-measuring-resistor having a transition point in volume resistivity, the resistor has a temperature region in which the volume resistivity deviates greatly and drastically from a value calculated according to the above-mentioned equation.

In the above equation, T is an absolute temperature, ρ is a volume resistivity at the temperature T. ρ∞ is a volume resistivity at the infinitely high temperature and B is a so-called thermistor constant which is inherent to the respective temperature-measuring-resistors. The TCR at the temperature T, which follows a change in temperature, is obtainable from the equation: $-B/T^2\times100$(%/K).

It is preferable that the temperature-measuring-resistor has no temperature region where the relation between the measured temperature and the measured volume resistivity deviates greatly and drastically from the equation (I) in the temperature range of −10° to 50° C., particularly in the temperature range of −20° to 80° C. (the region being "drastically-volume-resistivity-changing temperature region" as defined hereinbelow), when the actually measured temperature of the temperature-measuring-resistor is plotted as the inverse number of the absolute temperature (1/T) and the actually measured volume resistivity is plotted as the logarithm of the volume resistivity (log ρ). Also it is particularly preferable that the temperature-measuring-resistor has a wide temperature range where the volume resistivity does not change greatly.

Figure 4:
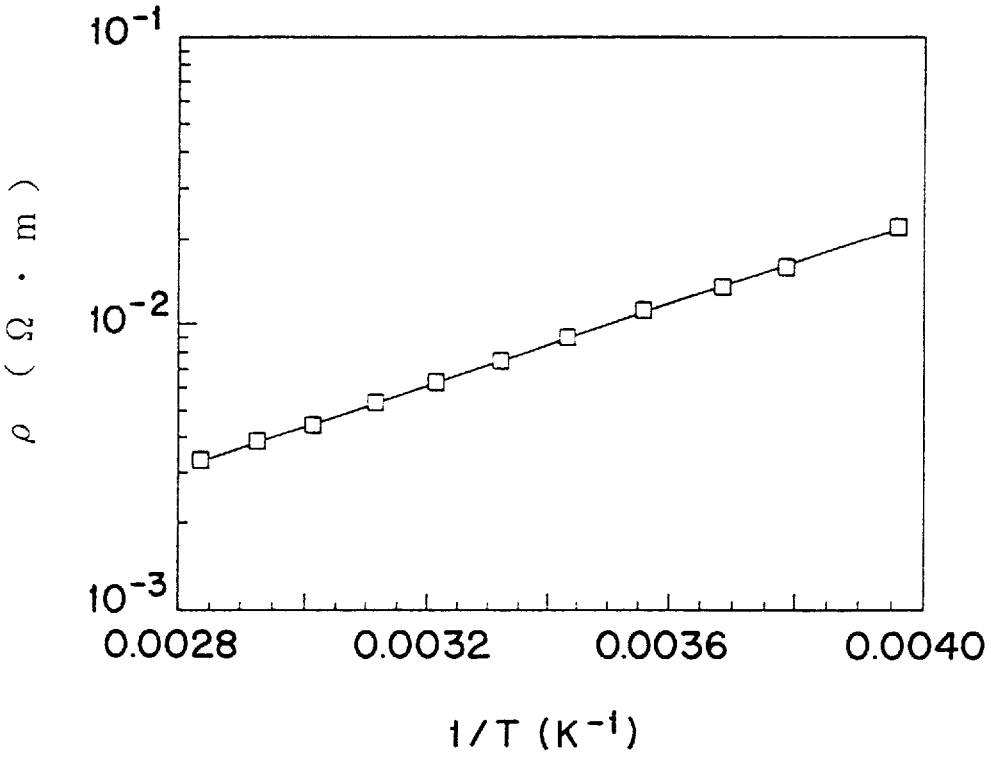
FIG. 4 is a graph showing the relationship between the volume resistivity and the temperature of the temperature-measuring-resistor of Experimental No. 6-(4) in Example 6 which is prepared under a mixed gas atmosphere in case where the volume ratio of nitrogen gas/oxygen gas is 20:7.

FIG. 4 shows the relationship between the volume resistivity and the temperature in the temperature range of −20° to 80° C., of the temperature-measuring-resistor of Experimental No. 6-(4) in Example 6 mentioned hereinafter.

The above-mentioned "drastically-volume-resistivity-changing temperature region" means a temperature range as defined below. Namely, in the equation:

$$\rho=\rho\infty\exp(B/T)$$

which approximately represents a relation between the volume resistivity and the inverse number of temperature 1/T. The thermistor constant B and the volume resistivity ρ∞ at an infinitely high temperature are calculated from an actually measured temperature and volume resistivity of the temperature-measuring-resistor. After substituting the calculated values of B and ρ∞ into that equation, the volume resistivity (ρT1) at a certain temperature T1, the volume resistivity (ρT1+1) at the temperature T1+1 higher than T1 by 1° C. and the volume resistivity at the temperature T1−1 lower than T1 by 1° C. are calculated. In that case, the above-mentioned "drastically-volume-resistivity-changing temperature region" is a temperature region where a variation of the volume resistivity, i.e. (ρT1)−(ρT1+1) or (ρT1)−(ρT1−1) deviates from the region of ±20% of the volume resistivity ρT1.

In case where the above-mentioned variation of the volume resistivity deviates from the region of ±20%, the variation of the volume resistivity is too large. Therefore if temperature measuring devices using such temperature-measuring resistor are mass-produced, there is a tendency such that a variation of resistance of temperature measuring elements occurs and the yield is decreased, and thus resulting in an increase in production costs.

The use of the temperature-measuring-resistor of the present invention, which has no drastically-volume-resistivity-changing temperature region in the temperature range of −10° to 50° C., particularly −20° to 80° C., makes it possible to produce a highly sensitive temperature measuring element and a device which can achieve highly accurate temperature measurements.

Since the constant B is constant in the above-mentioned temperature range of −20° to 80° C., the TCR itself varies with temperature change. It is preferable that at room temperature of around 27° C. (300 K), the absolute value of the TCR of the temperature-measuring-resistor falls in the range of 0.7 to 20%/K and the volume resistivity is not more than 20 mΩ·m.

When a temperature-measuring-resistor having an absolute value of the TCR of lower than 0.7%/K is used for a temperature measuring element, since the TCR change with temperature change is small, measuring sensitivity of the resistor is lowered. When a temperature-measuring-resistor having an absolute value of the TCR of more than 20%/K is used for a temperature measuring element, matching of the volume resistivity becomes difficult, and yield of the temperature measuring elements is decreased. Also, when a temperature-measuring-resistor having a volume resistivity higher than 20 mΩ·m is used for a temperature-measuring element in the form of a film, since its resistance is remarkably increased, self-heat generation is increased when electric power passes for sensing, and thus an accurate measuring signal becomes difficult to be obtained.

In case of the temperature-measuring-resistor (1), it is preferable that the electrically conductive material comprises a metal or metal oxide, and that as the metal or metal oxide, there is at least one selected from the group consisting of platinum, iridium, rhodium, platinum oxide, iridium oxide, rhodium oxide and ruthenium oxide. They are advantageous from the points that since those metals and metal oxides are chemically stable, they are hard to deteriorate in the state of being contained in the matrix material, i.e. the vanadium oxide, and thus desired characteristics of the volume resistivity and TCR of the temperature-measuring-resistor are exhibited stably with the lapse of time. Particularly in case where the ruthenium oxide is used as the electrically conductive material, it is advantageous from a point that the desired characteristics of the volume resistivity and TCR of the temperature-measuring-resistor are exhibited stably with the lapse of time.

It is preferable that the electrically conductive material comprises a metal nitride and that as the metal nitride, there is at least one selected from the group consisting of a titanium nitride, niobium nitride and tantalum nitride. They are advantageous because the electric conductivity of those metal nitrides is high, which makes the volume resistivity of the temperature-measuring-resistor lower, and that those nitrides are hard to deteriorate even in the state of being contained in the matrix material comprising the vanadium oxide since they are stable chemically, and thus the characteristics of the volume resistivity of the temperature-measuring-resistor and its TCR become stable with the lapse of time.

Also, it is preferable that the number of metal atoms derived from the electrically conductive material is in the range of 5 to 70% of the total metal atoms in the temperature-measuring-resistor, particularly in the range of 5 to 50%. When the number of metal atoms derived from the electrically conductive material is less than 5%, there is a tendency that the volume resistivity of the temperature-measuring-resistor is not lowered to a proper value, and when more than 70%, there is a tendency that the absolute value of the TCR of the temperature-measuring-resistor is not increased to a proper value.

In case where the electrically conductive material comprises a metal nitride such as vanadium nitride (VN), the vanadium nitride is easily incorporated into the matrix material, i.e. the vanadium oxide, and the vanadium nitride can be present very stably in the state of being incorporated therein. Therefore, it is advantageous because the manufacturing process of the temperature measuring element can be simplified, and the flexibility in the structural design and manufacturing process of the temperature measuring element is increased. Also the temperature-measuring-resistor having a suitably lowered volume resistivity can be obtained by incorporating the vanadium nitride into the vanadium oxide.

In case where the electrically conductive material comprises a metal nitride, i.e. the vanadium nitride, it is preferable that, assuming that a ratio of the number of nitrogen atoms to the sum of nitrogen atoms and oxygen atoms in the temperature-measuring-resistor is represented by X, the ratio X is in the range shown by the equation:

$$0<X\leqq 0.67,$$

more preferably $$0<X\leqq 0.3.$$

In the case where the ratio X is zero, that is, the electrically conductive material being absent, it is not preferable because the volume resistivity of the temperature-measuring-resistor at room temperature of around 27° C. (300 K) becomes larger than 20 mΩ·m. In the case where the ratio X is more than 0.67, it is not preferable because when forming a temperature-measuring-resistor, vanadium oxide of the matrix material is easy to react with vanadium nitride of the electrically conductive material, and thus there easily occurs deterioration of the matrix material and the electrically conductive material, thereby there is a tendency such that the absolute value of TCR is lowered to less than 0.7%/K at room temperature of around 27° C. (300 K). In order to sufficiently decrease such deterioration of the vanadium oxide of the matrix material and/or the vanadium nitride of the electrically conductive material, it is more preferable that the above ratio X is not more than 0.3.

The number of nitrogen atoms and the number of oxygen atoms can be obtained by assuming that integrated value (area) of peaks based on the nitrogen atoms derived from vanadium nitride and integrated value (area) of peaks based on the oxygen atoms derived from vanadium oxide through an X-ray electron spectroscopy (XPS) correspond to the respective number of atoms.

In case of the temperature-measuring-resistor (2) described above, it is preferable that, assuming that a ratio of the number of nitrogen atoms to the sum of nitrogen atoms and oxygen atoms in the vanadium compound containing vanadium, oxygen and nitrogen is represented by Y, the ratio Y is in the range shown by the equation:

$$0<Y\leqq 0.52,$$

more preferably $$0.05\leqq Y\leqq 0.52,$$

particularly preferably $$0.16\leqq Y\leqq 0.52.$$

When the ratio Y is less than the above range, there is a tendency that the volume resistivity of the obtained temperature-measuring-resistor is not lowered to a desired value, and when more than the above range, the absolute value of TCR of the temperature-measuring-resistor is not increased to a proper value.

It is also preferable that the average valency of the vanadium atoms in the vanadium compound containing vanadium, oxygen and nitrogen is in the range of 4.2 to 4.9, particularly in the range of 4.2 to 4.8. When the average valency of the vanadium atoms is less than 4.2, there is a tendency that the transition point where the absolute value of TCR of the temperature-measuring-resistor is larger than 20%/K is easy to occur, and when more than 4.9, there is a tendency that the volume resistivity of the temperature-measuring-resistor is not lowered to a proper range.

The above-mentioned temperature-measuring-resistor (1) can be manufactured by physical vapor deposition method under gas atmosphere by use of a composite vapor-deposition source comprising the first material for forming vanadium oxide and the second material for forming at least one of a metal, metal oxide and metal nitride which has an electric conductivity higher than that of vanadium oxide.

(1a): One specific embodiment of the methods of manufacturing the temperature-measuring-resistor (1) is physical vapor-deposition under inert gas atmosphere by use of a composite vapor-deposition source comprising the first material, i.e. vanadium oxide and the second material, i.e. the metal and/or metal oxide.

According to the above-mentioned physical vapor-deposition method, composition of materials for the vapor-deposition source becomes nearly the same as that of a formed film. In the case where a plurality of vapor-deposition sources are used, the composition of the obtained film becomes a mixture of plural materials for the vapor-deposition source. Examples of the physical vapor-deposition method are sputtering method such as RF sputtering, DC sputtering, conventional sputtering, magnetron sputtering, ECR sputtering or ion beam sputtering; electron beam vapor-deposition method; laser abrasion method; and the like (hereinafter the same when using the physical vapor-deposition in the other manufacturing methods of the temperature-measuring-resistor according to the present invention).

As examples of the vanadium oxides described above, there are known mainly VO, $V_2O_3$, $V_2O_5$ and $VO_2$ as crystalline ones, and in addition, there are many other vanadium oxides having different structures and also non-crystalline vanadium oxides. In the case where the vanadium oxide is used as a vapor-deposition source (hereinafter may also be referred to as "target") for forming a film, divanadium pentoxide is preferable as the target (hereinafter the same in case where the vanadium oxide is used in the present invention).

As the metal oxides having a higher electric conductivity than that of the vanadium oxides described above, there are, for example, ruthenium oxides ($RuO_2$ and the like), rhenium oxides ($ReO_3$ and the like), osmium oxides ($OsO_2$ and the like), iridium oxides ($IrO_2$ and the like), rhodium oxides ($RhO_2$ and the like), platinum oxides ($PtO_2$ and the like), chromium oxides ($CrO_2$ and the like), tungsten oxides ($WO_2$ and the like), molybdenum oxides ($MoO_2$, $Mo_4O_{11}$ and the like), vanadium type oxides ($Li_2V_2O_4$ and the like), tin oxides ($SnO_2$ and the like), tin type oxides ((In, Sn) $O_2$ and the like) or titanium type oxides ($LiTi_2O_4$ and the like), and particularly $RuO_2$, $lrO_2$, $RhO_2$ and $PtO_2$ are preferable in view of chemical stability (hereinafter the same when the metal oxide is used as the electrically conductive material according to the present invention).

As the metal having a higher electric conductivity than that of the above-mentioned vanadium oxide, there are, for example, platinum, rhodium, iridium, gold and the like (hereinafter the same in case where the metal is used as the electrically conductive material in the present invention). These metals are preferable from a point that, in manufacturing a temperature-measuring-resistor, they have sufficient resistance to oxidation in oxidizing environment, that is, oxidation due to a vapor-deposition source containing oxides.

The above-mentioned composite vapor-deposition source can be selected from the following two types (hereinafter the same in case where the composite vapor-deposition source is used in the manufacturing method of the present invention). That is, type (A) where the above-mentioned first material is used as one target, and the second material is used as another target (composite vapor-deposition source in this case may be hereinafter referred to as "multi-target"); and type (B) where the first material and the second material are mixed to form one target (composite vapor-deposition source in this case may be hereinafter referred to as "mixed-target").

In the case of using the multi-target as the composite vapor-deposition source, the ratio of the number of metal atoms derived from the electrically conductive material to the total metal atoms in the temperature-measuring-resistor or the ratio of the number of nitrogen atoms to the sum of nitrogen atoms and oxygen atoms in the temperature-measuring-resistor can be adjusted by controlling a power to be applied to the respective targets of the multi-target independently to adjust the amounts of particles derived from the first and second materials in the respective targets.

In the case of one manufacturing method of the present invention using the mixed-target as the composite vapor-deposition source, the mixed-target is so produced that the ratio of the number of metal atoms in the first material to that in the second material is made the same as the ratio of the number of metal atoms derived from the vanadium oxide of the matrix material in the temperature-measuring-resistor to the number of metal atoms derived from the electrically conductive material or that the ratio of the number of nitrogen atoms to the number of oxygen atoms in the first and second materials is made the same as the ratio of the number of nitrogen atoms to the number of oxygen atoms in the temperature-measuring-resistor.

However, in the case of using the sputtering method, which is one typical physical vapor-deposition method, and using the mixed-target, the amount of particles derived from the first material in the target differs from that derived from the second material, depending on the sputtered ratios of each material in the mixed-target, even if the mixing ratio of the first and second materials in the mixed-target is the same. For that reason, the ratio of the number of metal atoms in the first material to the number of metal atoms in the second material, both of which are contained in the mixed-target, or the ratio of nitrogen atoms to oxygen atoms in the first and second materials is determined in consideration of the respective sputtered ratios of the first and second materials, so that there can be obtained the desired ratio of the number of metal atoms derived from the electrically conductive material to the total metal atoms in the temperature-measuring-resistor or the desired ratio of the nitrogen atoms to the sum of nitrogen atoms and oxygen atoms in the temperature-measuring-resistor.

Also, in the case of using the electron beam vapor-deposition which is another one of the typical physical vapor-deposition methods, the amount of particles derived from the first material in the mixed-target differs from that derived from the second material, depending on melting points of each material mixed in the mixed-target. For that reason, the ratio of the number of metal atoms in the first material to the number of metal atoms in the second material, both of which are contained in the mixed-target, is determined in consideration of the respective melting points of the first and second materials, so that there can be obtained the desired ratio of the number of metal atoms derived from the electrically conductive material to the total metal atoms in the temperature-measuring-resistor or the desired ratio of the nitrogen atoms to the sum of nitrogen atoms and oxygen atoms in the temperature-measuring-resistor.

In the manufacturing method of the present invention, the above-mentioned mixed-target is generally used preferably in case where the electrically conductive material comprises a metal oxide, that is, both the matrix material and electrically conductive material are metal oxides, or in case where vanadium is contained in the electrically conductive material, that is, vanadium is contained in both the matrix material and electrically conductive material. In that case, in the process of producing the mixed-target, deterioration of each material and reaction therebetween are minimized.

As the methods of producing the mixed-target, there are mainly used a method wherein a mixture of a powder of the first material and a powder of the second material is sintered; a method wherein the mixture of both powder materials is pressed to be pelletized; a method wherein both materials are melted to form an alloy thereof; and the like.

As the above-mentioned inert gas, it is preferable to use argon gas because it is chemically very inactive (hereinafter the same in case of using the inert gas in the present invention).

The temperature-measuring-resistor of the present invention can be manufactured through the physical vapor-deposition method by using the above-mentioned composite vapor-deposition source. Among the physical vapor-deposition methods, the above-mentioned sputtering method and the electron beam vapor-deposition method are preferable because the temperature-measuring-resistor can be made homogeneous and the electrically conductive material can be incorporated into the matrix material, i.e. vanadium oxide in the state of being mixed up to the micro level such as atomic level.

As the preferable conditions for the above-mentioned sputtering methods and the electron beam vapor-deposition method in this manufacturing method, there can be adopted various combinations of the conditions such as the pressure of gas, the input power to be applied to the vapor-deposition source and the temperature of substrate, and each condition is variable in a wide range.

As the typical example of preferable manufacturing conditions described above, in the case of the sputtering method, the pressure of gas at forming a film is in the range of about $10^{-4}$ to about $10^{-2}$ Torr, the temperature of substrate is in the range of about 200° C. to about 600° C. and the power to be applied to the vapor-deposition source is in the range of about 50 W to about 150 W when using a 3 inch target. In the case of the electron beam vapor-deposition method, the pressure of gas at forming a film is around $10^{-4}$ Torr, the temperature of substrate is in the range of about 200° C. to about 600° C. and the power to be applied to the vapor-deposition source is such a power as to enable a deposition rate of around 10 Å per second to be obtained.

According to the above-mentioned manufacturing method (1a), the temperature-measuring-resistor, in which the number of metal atoms derived from the electrically conductive material is in the range of 5 to 70% of the total metal atoms in the temperature-measuring-resistor, can be manufactured under the above-mentioned typical vapor-deposition conditions.

Also, according to the above-mentioned manufacturing method (1a), there can be manufactured, under the above-mentioned typical vapor-deposition conditions, the temperature-measuring-resistor having the ratio X of the range defined by the equation: $0<X\leqq 0.67$ when the ratio X is assumed to be a ratio of the number of nitrogen atoms to the sum of nitrogen atoms and oxygen atoms in the vanadium oxide containing the vanadium nitride.

(1b); Another embodiment of the method of manufacturing the above-mentioned temperature-measuring-resistor (1) is reactive physical vapor-deposition under a gas atmosphere containing a nitriding gas by use of, as the composite vapor-deposition source, vanadium oxide as the first material and a metal nitride and/or metal as the second material having electric conductivity higher than that of the vanadium oxide.

As the vanadium oxide and the metal, there can be used the same ones as those of (1a) described above.

The metal nitrides having a higher electric conductivity than that of the above-mentioned vanadium oxide are, for example, vanadium nitrides (VN and the like), titanium nitrides (TiN and the like), tantalum nitrides (TaN and the like), niobium nitrides (NbN and the like) or zirconium nitrides (ZrN and the like). And particularly vanadium nitride is preferable because of being easily mixed properly in the matrix material comprising the vanadium oxide and also because the structure of the temperature-measuring-resistor is stabilized since the matrix material and the electrically conductive material contain the same metal element. And also a titanium nitride, niobium nitride and tantalum nitride are particularly preferable because they can be obtained relatively easily, and that their resistance to oxidation is excellent.

The above-mentioned composite vapor-deposition source can be selected from the two types described above, i.e. the multi-target and the mixed-target. Also, the ratio of the vanadium oxide as the matrix material to the electrically conductive material in the temperature-measuring-resistor can be adjusted by preparing the composite vapor-deposition source in the same manner as in the above (1a) and controlling the amounts of particles derived from the first and second materials in the same manner as in above (1a).

The nitriding gas means a gas being capable of giving nitrogen atoms to deposited particles through the reaction with the deposited particles when forming a film of a temperature-measuring-resistor. There are, for example, nitrogen gas, ammonia gas and the like. Nitrogen gas is preferable because it is handled easily (hereinafter the same when using the nitriding gas in the other manufacturing methods of the temperature-measuring-resistor according to the present invention). The gas atmosphere in the method (1b) may contain an inert gas such as argon gas in addition to the nitriding gas.

The temperature-measuring-resistor of the present invention can be manufactured by the reactive physical vapor-deposition method under a gas atmosphere containing the nitriding gas by using the above-mentioned composite vapor-deposition source. Among the reactive physical vapor-deposition methods, a reactive sputtering method or a reactive electron beam vapor-deposition method is preferable for the same reason as stated in the above (1a).

In the manufacturing method described above, as the preferable conditions for the above-mentioned reactive sputtering method and the reactive electron beam vapor-deposition method, there can be adopted various combinations of the conditions such as the pressure of gas, the input power to the vapor-deposition source, the temperature of substrate and the like, and each condition is variable in a wide range.

As the typical example of those conditions, there are the same conditions as stated in the above (1a).

According to the above-mentioned reactive vapor-deposition method, since the materials (substances) for the vapor-deposition source are allowed to react with the gas atmosphere when forming a film of the temperature-measuring-resistor, the obtained film is a reaction product of the vapor-deposition materials and the gas atmosphere.

Examples of the reactive physical vapor-deposition method are reactive sputtering methods such as RF sputtering, DC sputtering, conventional sputtering, magnetron sputtering, ECR sputtering or ion beam sputtering; reactive vapor-deposition method using electron beam; reactive laser abrasion method; and the like (hereinafter the same when using the reactive physical vapor-deposition method in the other manufacturing methods of the temperature-measuring-resistor of the present invention).

According to the above-mentioned manufacturing method (1b), the temperature-measuring-resistor, in which the number of metal atoms derived from the electrically conductive material is in the range of 5 to 70% of the total metal atoms in the temperature-measuring-resistor, can be manufactured under the same typical vapor-deposition conditions as described in the above (1a).

Also, according to the above-mentioned manufacturing method 1(b), there can be manufactured, under the same typical vapor-deposition conditions as in above (1a), the temperature-measuring-resistor having the ratio X of the range defined by the equation: $0<X\leqq 0.67$ when the ratio X is assumed to be a ratio of the number of nitrogen atoms to the sum of nitrogen atoms and oxygen atoms in the vanadium oxide containing the vanadium nitride.

The temperature-measuring-resistor (2) can be manufactured by the methods mentioned below.

(2a); One example of the methods of manufacturing the temperature-measuring-resistor (2) is reactive physical vapor-deposition method under a gas atmosphere which contains a nitriding gas and may contain an oxidizing gas by using a material for a vapor-deposition source containing at least one of vanadium or vanadium oxide.

In the case where the material for the vapor-deposition source comprises vanadium oxide, a desired temperature-measuring-resistor can be manufactured under gas atmosphere containing a nitriding gas.

Gas atmosphere containing the nitriding gas which is prepared in the same manner as in the above (1b) can be used.

Also, in the case where the material for the vapor-deposition source comprises vanadium, a desired temperature-measuring-resistor can be manufactured under a mixed gas atmosphere of a nitriding gas and an oxidizing gas.

The oxidizing gas means a gas being capable of introducing oxygen atoms to the vapor-deposition particles through reaction with those particles when forming a film of the temperature-measuring-resistor. For example, there are oxygen gas, nitrous oxide gas ($N_2O$), ozone gas and the like. Among them, oxygen gas is advantageous because of its low cost, and nitrous oxide gas and ozone gas are advantageous because an oxidizing property (reactivity) is excellent.

Also as the nitriding gas, there can be used the same one as mentioned in the above-mentioned manufacturing method (1b).

As the mixed gas of the oxidizing gas and the nitriding gas, there can be preferably used a combination of oxygen gas and nitrogen gas, oxygen gas and ammonia gas or the like from a point of cost, and there is no problem particularly in the other combinations.

The suitable mixing ratio of the nitriding gas to the oxidizing gas in the mixed gas can be used within a wide range by taking account of kind of reactive physical vapor-depositions, apparatus therefor, method of gas introduction, other conditions for the reactive physical vapor-deposition and combination thereof.

For example, a typical volume ratio of the nitriding gas to the oxidizing gas is in the range of 20:1 to 20:8 in case of the conventional RF sputtering method, a substrate temperature of 400° C., an input power of 100 W and the mixed gas pressure of 7.5 m Torr at forming a film, when using nitrogen gas as the nitriding gas and oxygen gas as the oxidizing gas.

To the mixed gas may be added an inert gas such as argon gas, in case of the sputtering method to increase the film forming rate and to control oxidizing and nitriding forces, and in case of the electron beam vapor-deposition method, to control oxidizing and nitriding forces.

The temperature-measuring-resistor of the present invention can be manufactured through the reactive physical vapor-deposition method by using the above-mentioned vapor-deposition source under a gas atmosphere mentioned above.

In that manufacturing method, as the preferable conditions for the reactive physical vapor-deposition method, there can be used various wide combinations of kind of the vapor-deposition sources, kind of gas atmosphere, gas pressure, input power to the vapor-deposition source, substrate temperature and the like.

For the reactive physical vapor-deposition, it is preferable to use the reactive sputtering method or electron beam vapor-deposition method for the same reasons mentioned in manufacturing method (1b).

As the typical conditions for the reactive physical vapor-deposition, there can be used the same conditions as mentioned in (1a).

According to the above-mentioned manufacturing method (2a), there can be manufactured, under the same typical vapor-deposition conditions as in above (2a), the temperature-measuring-resistor having the range defined by the equation: $0<Y\leqq 0.52$ when the ratio Y is assumed to be a ratio of the number of nitrogen atoms to the sum of nitrogen atoms and oxygen atoms in the above-mentioned vanadium compound.

Also, according to the above-mentioned manufacturing method (2a), the temperature-measuring-resistor having an average valency of vanadium atoms in the above-mentioned vanadium compound in the range of 4.2 to 4.9 can be manufactured.

(2b); Another embodiment of the manufacturing method of the temperature-measuring-resistor (2) is a method wherein a vanadium compound containing vanadium, oxygen and nitrogen is formed by subjecting a vapor-deposition source containing at least one of vanadium or vanadium oxide to the reactive physical vapor-deposition under the gas atmosphere which contains nitriding gas and may contain oxidizing gas, and then annealing the vanadium compound under the oxidizing gas atmosphere.

The above-mentioned vanadium compound can be produced in the same manner as in the above-mentioned method (2a) of manufacturing the temperature-measuring-resistor.

However, in the manufacturing method 2(b), after forming the vanadium compound, since it is annealed under the oxidizing gas atmosphere, an oxidizing force of the above-mentioned gas atmosphere for the vapor-deposition may be weak or zero.

In the above-mentioned process for preparing the vanadium compound, it is further preferable that a typical example of the gas atmosphere which contains the nitriding gas and may contain the oxidizing gas is one having a volume ratio of the introduced nitrogen gas to the introduced oxygen gas of 20:not more than 1, particularly 20:0.2 to 1, for example, in case of using vanadium as the material for the vapor-deposition source, RF conventional sputtering method, substrate temperature of 400° C., sputtering power of 100 W, gas pressure of 7.5 m Torr at forming a film, when using nitrogen gas as the nitriding gas and oxygen gas as the oxidizing gas (there is a case where the oxidizing gas is not used).

As the conditions for the reactive physical vapor-deposition method, there can be used the same conditions as described in the above (2a) for the reactive physical vapor-deposition methods.

The temperature-measuring-resistor of the present invention can be obtained by annealing, under the oxidizing gas atmosphere, the vanadium compound obtained as mentioned above.

As the atmosphere gas at annealing, i.e. oxidizing gas, there can be used oxygen gas, a mixed gas of nitrogen gas and oxygen gas, a mixed gas of argon gas and oxygen gas, and the like. Each gas or mixed gas can be suitably used since the oxidizing force of the oxidizing gas can be controlled, for example, by adjusting the annealing conditions, such as the annealing temperature. Also, the oxidizing force of the above-mentioned mixed gases can be controlled by adjusting the mixing ratio thereof. However, it is preferable to use the gas consisting of 100% of oxygen gas because the gas is not in an unstable condition, such as heterogeneous mixing. Using the gas consisting of 100% of oxygen gas is advantageous because regular quality products can be produced repeatedly, and is preferable because the production process can be simplified since it is not necessary to mix gases.

In the case of the gas atmosphere consisting of 100% of oxygen gas, the above-mentioned annealing can be carried out, for example, by holding at 300° C. for 2 to 4 hours.

According to the above-mentioned manufacturing method 2(b), there can be manufactured under the above-mentioned typical mixing gas ratio and vapor-deposition conditions, the temperature-measuring-resistor having the ratio Y of the range defined by the equation: $0<X\leqq 0.52$ when the ratio Y is assumed to be a ratio of the number of nitrogen atoms to the sum of nitrogen atoms and oxygen atoms in the vanadium compound.

Also, according to the above-mentioned manufacturing method (2b), the temperature-measuring-resistor having an average valency of vanadium atoms in the above-mentioned vanadium compound in the range of 4.2 to 4.9 can be manufactured.

Also, the temperature-measuring-resistor having a lower volume resistivity at room temperature and a larger TCR can be manufactured by incorporating electrically conductive materials comprising one or more of a metal, metal oxide and metal nitride which have an electric conductivity higher than that of the vanadium compound, into the vanadium compound prepared through the method described in (2a) or (2b). Those metal, metal oxide and metal nitride having an electric conductivity higher than that of the vanadium compound may be selected among those mentioned in (1a) or (1b). Also, the above-mentioned temperature-measuring-resistor can be manufactured, for example, through the reactive physical vapor-deposition method under the mixed gas atmosphere comprising the nitriding gas and the oxidizing gas by using a composite vapor-deposition source comprising vanadium as the first material and the metal, metal oxide and metal nitride as the second materials.

The temperature-measuring-resistors of the present invention, which are obtained through the above-mentioned methods, are advantageous as compared with the conventional temperature-measuring-resistor from the points that since the volume resistivity at room temperature of around 27° C. (300 K) is low, a large amount of self-heat generation does not occur when electric current is turned on at around room temperature and that because of less self-heat generation and a large TCR, a temperature can be measured and detected highly accurately.

The preferable thickness of the temperature-measuring-resistor of the present invention is in the range of 200 to 20,000 Å because a temperature can be very accurately measured and detected.

The temperature-measuring-resistor of the present invention is suitably used on a temperature measuring portion of the temperature measuring element.

The temperature measuring element generally comprises a pair of electrodes and a temperature-measuring resistor, and the temperature-measuring-resistor composes the temperature measuring portion. Also, usually the temperature measuring element is formed on an insulative film provided on a silicon substrate, and a pair of electrodes of the temperature measuring element is connected to a signal processing circuit, thus constructing a temperature measuring device.

For the temperature measuring element of the temperature measuring device, when the conventional temperature-measuring-resistor is made small and thin and the element is constructed in such a manner that the electrodes are opposed in one plane, increase of impedance and lowering of response characteristics occur because of the high volume resistivity. Therefore, it is necessary to employ a construction that the resistor is sandwiched between the planes of the electrodes.

FIGS. 7(*a*) and 7(*b*) show an example of a conventional temperature measuring device of sandwiched-type. FIG. 7(*a*) is a plan view of the temperature measuring device, and FIG. 7(*b*) is a cross-sectional view of a line D—D of the plan view 7(*a*). In these drawings, numeral 30 is a silicon substrate, numeral 31 is an insulative film, numeral 32 is an electrode, numeral 33 is a temperature-measuring-resistor and numeral 34 is an electrode. Though the temperature measuring device is required to be produced at very low cost, the temperature measuring devices using the conventional temperature-measuring-resistor are not satisfactory because they cannot be manufactured at low cost, since more masks are required for manufacturing the devices, that is, the number of production steps increases.

On the contrary, in the case of the temperature measuring element using the temperature-measuring-resistor of the present invention, the element can be of simple plane type electrode construction for the reason that the volume resistivity of temperature measuring portion can be decreased even if the resistor is made thin like a film. This plane type electrode construction makes it possible to make the temperature measuring element and device thin. Also, in the manufacturing process, a pair of electrodes can be formed by using only one mask, which results in dispensing with one mask as compared with the process for manufacturing the conventional temperature measuring element. Also according to the temperature measuring device of the present invention, there is a tendency that a tolerance against defects (including cracks and the like) is large, and percentage defectives and production cost can be decreased because of improvement of the yield.

Also, it is naturally evident that in the temperature measuring device in which the temperature-measuring-resistor of the present invention is used for the conventional temperature measuring element having a construction of the sandwiched-type electrodes, there are exhibited effects such as highly accurate temperature measurement and excellent response characteristics.

Further, by connecting the temperature measuring element using the temperature-measuring-resistor of the present invention with the signal processing circuit on the same substrate to integrate them, that is, by providing the signal processing circuit and the temperature measuring element comprising a pair of electrodes and the temperature-measuring-resistor of the present invention on the same substrate and then electrically connecting the pair of the electrodes and the signal processing circuit, it is possible to give a temperature measuring device having an integrated temperature measuring element with signal processing circuit. In the conventional temperature measuring device in which a line having a low TCR is used between the temperature measuring portion and the signal processing circuit, there were problems of parasitic resistance in the line and noise invading from the line. However in the temperature measuring device of the present invention, in which the temperature measuring element and signal processing circuit are integrated, those problems can be eliminated, that is, it is possible to decrease said parasitic resistance and to lower said noise, which results in realization of higher sensitivity.

Further the temperature measuring device in which the temperature measuring element is provided on or near a portion where its temperature is measured (hereinafter referred to as "temperature-measured portion") makes it possible to measure the temperature very accurately. As the preferable embodiments of such temperature measuring devices, there are ones wherein the temperature-measured portion is provided on the substrate and the temperature measuring element is provided adjacent to, overlapped with or partly overlapped with the temperature-measured portion. When the temperature-measured portion is overlapped with the temperature measuring element, an insulative film having a required thickness and a desired heat conductivity may be provided between them in case where they should not be brought into contact electrically with each other.

It is particularly advantageous to use the temperature measuring device, in which the temperature-measured portion and the temperature measuring element are provided adjacent to, overlapped with or partly overlapped with each other, for apparatuses where a very accurate temperature measurement is required, for instance, electronic apparatuses, various circuit monitors such as transistor circuits, overheat-preventing sensors or the like. The temperature measuring device using the temperature-measuring-resistor of the present invention also can be used as a thermo-switch, and in that case, the thermo-switch can be operated highly accurately to protect at an early stage in case of overheating of the temperature-measured portion.

FIGS. 1(*a*) and 1(*b*) show an embodiment of the temperature measuring device in which the temperature measuring element has the electrodes of plane structure is connected with the signal processing circuit on the same substrate to be integrated and is provided on the neighborhood of the temperature-measured portion. The temperature-measured portion of this device is a transistor circuit. FIG. 1(*a*) is a plan view of the temperature measuring device and FIG. 1(*b*) is a cross-sectional view of a line A—A of FIG. 1(*a*). In the figures, numeral 1 is a silicon substrate, numeral 2 is an insulative film, numerals 3 and 4 are electrodes, numeral 5 is a temperature-measuring-resistor, numeral 6 is a signal processing circuit and numeral 7 is a transistor circuit, i.e. the temperature-measured portion.

The temperature measuring device is so manufactured that the transistor circuit 7, i.e. the temperature-measured portion and then the signal processing circuit 6 are provided on the silicon substrate 1, the insulative film 2 is coated on the circuits 6 and 7, contact holes are made in the insulative film, for example, by ion beam etching or the like and the electrodes 3 and 4 are provided on the insulative film 2, followed by electrically connecting the electrodes 3 and 4 with the signal processing circuit 6.

This temperature measuring device can monitor a temperature of the transistor circuit very accurately.

Also, the temperature-measuring-resistor of the present invention can be used on an infrared-ray detecting portion of an infrared-ray detecting element.

An infrared-ray detecting element using a resistor generally comprises a pair of electrodes and a temperature-measuring-resistor which is an infrared-ray detecting portion. For instance, this infrared-ray detecting element is provided on a support film which has etching holes and is provided on a silicon substrate, and a pair of the electrodes of the infrared-ray detecting element is connected with a signal processing circuit, to give an infrared-ray detecting device.

In the case where such an infrared-ray detecting device is manufactured by using a conventional resistor film having a large TCR, the volume resistivity of the detecting portion is increased extremely. In order to assure impedance matching to the signal processing circuit or to increase a response rate, it is necessary to lower the volume resistivity of the detecting portion, and for that purpose, the area of the respective electrodes need be increased.

Figure 8:
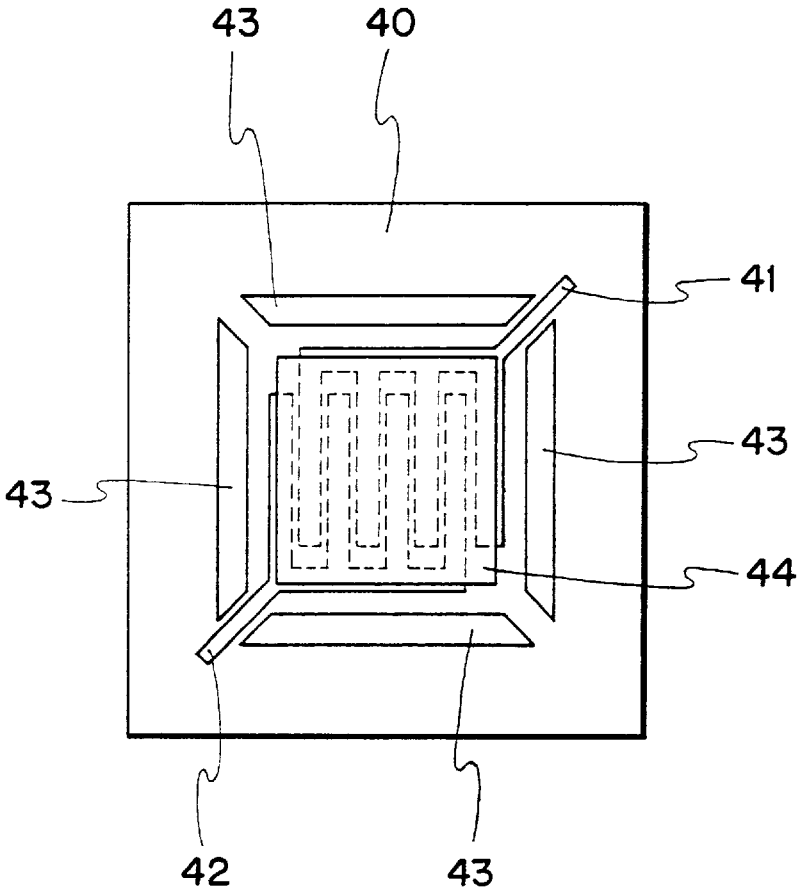
FIG. 8 is a plan view showing a construction of a conventional infrared-ray detecting element.

FIG. 8 is one example of the construction of such a conventional infrared-ray detecting device. FIG. 8 is a plan view of the above-mentioned infrared-ray detecting device, and in this drawing, numeral 40 is a support film, numerals 41 and 42 are electrodes, numeral 43 is an etching hole and numeral 44 is a temperature-measuring-resistor.

As shown in FIG. 8, a wider space is necessary for the electrodes of the conventional infrared-ray detecting element because of the reasons mentioned above. However, due to the wider space for the electrodes, there is a tendency that since the incident infrared ray transmitted through the temperature-measuring-resistor is reflected at the electrode portion, the detecting portion (a portion comprising the support film, electrodes and temperature-measuring-resistor) provided on a cavity (not shown in FIG. 8) of the infrared-ray detecting device is not heated to a desired temperature by the infrared ray and the temperature-measuring-resistor cannot sufficiently detect the infrared ray because the temperature-measuring-resistor is not heated to a proper temperature. For this reason, it is difficult to effectively detect the infrared ray by means of the infrared-ray detecting device with the conventional element as mentioned above.

On the contrary, the infrared-ray detecting element with the temperature-measuring-resistor of the present invention has a low volume resistivity, and therefore, even in the case where the resistor is made thin, since the resistance of the detecting portion is small, there can be eliminated problems with the impedance matching to the signal processing circuit and the response characteristics. Thus, the area of the electrodes can be decreased, thereby enabling the space for the electrodes to be small.

The temperature-measuring-resistor of the present invention can be used as the electrodes of the infrared-ray detecting element and as a line material from the electrodes to the signal processing circuit, which makes it possible to reduce the area of the infrared ray reflecting portion, and thus infrared absorption can be increased and sensitivity of the infrared-ray detecting element can be enhanced.

Further, by connecting the infrared-ray-detecting element using the temperature-measuring-resistor of the present invention as the infrared-ray detecting material with the signal processing circuit on the same substrate to integrate them, that is, by providing the signal processing circuit and the infrared-ray detecting element comprising a pair of electrodes and the temperature-measuring-resistor of the present invention on the same substrate and then electrically connecting the pair of the electrodes with the signal processing circuit, it is possible to give an infrared-ray detecting device having an integrated infrared-ray detecting element and signal processing circuit.

In such an infrared-ray detecting device, since the distance between the infrared-ray detecting element and the signal processing circuit connected to each other is very short, any parasitic resistance can be eliminated, and since the infrared-ray detecting element and the signal processing circuit are integrated with each other, the mechanically connected portion is eliminated. Thus, it is advantageous from the viewpoint of sensitivity and reliability of the infrared-ray detecting element.

FIGS. 2(*a*) and 2(*b*) show an embodiment of the infrared-ray detecting device of the present invention. FIG. 2(*a*) is a plan view of the infrared-ray detecting device, and FIG. 2(*b*) is a cross-sectional view of a line B—B of FIG. 2(*a*). In FIGS. 2(*a*) and 2(*b*), numeral 8 is a silicon substrate, numeral 9 is a support film, numeral 10 is an etching hole, numerals 11 and 12 are electrodes, numeral 13 is a temperature-measuring-resistor, numeral 14 is a cavity and numeral 15 is a protective film.

According to that infrared-ray detecting device, since the formation of the protective film 15 protects the detecting portion comprising the temperature-measuring-resistor and electrodes from external environment, preferable physical properties are exhibited stably for a long period of time, infrared rays can be detected accurately and reliability of the infrared-ray detecting element can be enhanced.

The present invention is explained below based on Examples, but is not limited thereto.

EXAMPLE 1

A film of a temperature-measuring-resistor was formed on a thermal-oxidized film (insulative film) of a silicon substrate by RF sputtering under argon as atmosphere containing 1% oxygen, by using a multi target of divanadium pentoxide as the first material for forming vanadium oxide (hereinafter also referred to as the "first material") and ruthenium oxide as the second material for forming an electrically conductive material (hereinafter also referred to as the "second material") (described as $RuO_2/V_2O_5$ in Table 1), a multi target of divanadium pentoxide as the first material and platinum as the second material (described as $Pt/V_2O_5$ in Table 1), a multi target of divanadium pentoxide as the first material and iridium as the second material (described as $Ir/V_2O_5$ in Table 1) or a multi target of divanadium pentoxide as the first material and rhodium as the second material (described as $Rh/V_2O_5$ in Table 1).

The temperature of the above-mentioned silicon substrate and an atmosphere gas pressure in forming the film were regulated to 250° C. and 1 Pa, respectively. The sputtering power was adjusted as shown in Table 1. Under the above-mentioned conditions, a film having a thickness of about 1,000 Å was formed in about 20 minutes. The thickness of the film was measured by a contact type thickness meter (DEKTAK 3030) available from Sloan Technology Co., Ltd. (hereinafter the same in measuring a thickness of the temperature-measuring-resistor).

As comparative examples, a film of the temperature-measuring-resistor was formed on a thermal-oxidized film of a silicon substrate by the RF sputtering under argon gas atmosphere by using divanadium pentoxide, ruthenium oxide, platinum, iridium or rhodium, respectively as the targets. The temperature of the silicon substrate, sputtering power and an atmosphere gas pressure in forming the film were regulated to 250° C., 100 W and 1 Pa, respectively.

Percentage (%) of the number of metal atoms derived from the electrically conductive material to the total number of metal atoms in the above-mentioned temperature-measuring-resistor film was measured by an electron probe X-ray microanalyzer (EPMA) (JXA-8621MX) available from JEOL: Japan Electron Optic Laboratory. The results are shown in Table 1.

A gold electrode was provided on the above-mentioned film of the temperature-measuring-resistor formed on the thermal-oxidized film on the silicon substrate to give a device for measuring a volume resistivity and TCR of the temperature-measuring-resistor as shown in FIGS. 3(*a*) and 3(*b*). FIG. 3(*a*) is a plan view of the device and FIG. 3(*b*) is a cross-sectional view of a line C—C of FIG. 3(*a*). In FIGS. 3(*a*) and 3(*b*), numeral 16 is a silicon substrate, numeral 17 is an insulative film, numeral 18 is a temperature-measuring-resistor and numeral 19 is a gold electrode for measuring.

Subsequently the volume resistivity of the temperature-measuring-resistor was measured in a temperature range of −20° to 80° C. through a four-terminal method by using the above-mentioned device (as shown in FIG. 3) comprising the silicon substrate, temperature-measuring-resistor and electrodes. The logarithm of the measured volume resistivity (log ρ) and the inverse number of the absolute temperature (1/T) were plotted to calculate the thermistor constant B according to the equation: $\rho=\rho\infty\exp(B/T)$, and then the TCR at 27° C. was determined. The volume resistivity at 27° C. was measured from the results of the measurements. The results are shown in Table 1.

TABLE 1

| Experimental Example | Vapor-deposition source*1 | Sputtering power (W) | Percentage of the number of metal atoms derived from the electrically conductive material to the total metal atoms in the temperature-measuring-resistor (%) Ru/total metals | Pt/total metals | Ir/total metals | Rh/total metals | Volume resistivity (mΩ · m) | TCR (%/K) |
|---|---|---|---|---|---|---|---|---|
| 1-(1) | $V_2O_5$ | 100 | — | — | — | — | 24.6 | −1.8 |
| 1-(2)) | $RuO_2/V_2O_5$ | $RuO_2$:25 $V_2O_5$:300 | 5 | — | — | — | 17.5 | −1.7 |
| 1-(3) | $RuO_2/V_2O_5$ | $RuO_2$:25 $V_2O_5$:150 | 15 | — | — | — | 10.2 | −1.7 |

TABLE 1-continued

| Experimental Example | Vapor-deposition source*1 | Sputtering power (W) | Percentage of the number of metal atoms derived from the electrically conductive material to the total metal atoms in the temperature-measuring-resistor (%) Ru/total metals | Pt/total metals | Ir/total metals | Rh/total metals | Volume resistivity (mΩ · m) | TCR (%/K) |
|---|---|---|---|---|---|---|---|---|
| 1-(4) | $RuO_2/V_2O_5$ | $RuO_2$:100 $V_2O_5$:100 | 55 | — | — | — | 0.35 | −1.6 |
| 1-(5) | $RuO_2/V_2O_5$ | $RuO_2$:150 $V_2O_5$:50 | 70 | — | — | — | 0.059 | −0.8 |
| 1-(6) | $RuO_2/V_2O_5$ | $RuO_2$:300 $V_2O_5$:25 | 95 | — | — | — | 0.003 | −0.3 |
| 1-(7) | $Pt/V_2O_5$ | Pt:50 $V_2O_5$:150 | — | 12 | — | — | 12.1 | −1.6 |
| 1-(8) | $Pt/V_2O_5$ | Pt:100 $V_2O_5$:150 | — | 63 | — | — | 0.38 | −1.6 |
| 1-(9) | $Ir/V_2O_5$ | Ir:100 $V_2O_5$:150 | — | — | 42 | — | 0.17 | −1.2 |
| 1-(10) | $Rh/V_2O_5$ | Rh:100 $V_2O_5$:150 | — | — | — | 39 | 4.7 | −1.3 |
| 1-(11) | $RuO_2$ | 100 | 100 | — | — | — | 0.002 | −0.3 |
| 1-(12) | Pt | 100 | — | 100 | — | — | 0.001 | 0.4 |
| 1-(13) | Ir | 100 | — | — | 100 | — | 0.001 | 0.3 |
| 1-(14) | Rh | 100 | — | — | — | 100 | 0.001 | 0.3 |

*1For the Experimental Examples of 1-(2) to 1-(10), a multi-target was used, and for the Experimental Examples of 1-(1) and 1-(11) to 1-(14), a single target was used, respectively.

EXAMPLE 2

A film of a temperature-measuring-resistor was formed on a thermal-oxidized film (insulative film) on a silicon substrate by RF sputtering under the argon gas atmosphere, by using a mixed-target prepared by mixing the second material shown in Table 2 to the first material shown in Table 2 in an amount of 25% by mole based on the first material.

The same gold electrode as in Example 1 was then provided on the film of the temperature-measuring-resistor formed on the thermal-oxidized film on the above-mentioned silicon substrate, and a volume resistivity at 27° C. and TCR at 27° C. were evaluated in the same manner as in Example 1. The results are shown in Table 2.

TABLE 2

| Experimental Example | Vapor-deposition source*1 First material | Second material | Percentage of the number of metal atoms derived from the electrically conductive material to the total metal atoms in the temperature-measuring-resistor (%) | Volume resistivity (mΩ · m) | TCR (%/K) |
|---|---|---|---|---|---|
| 2-(1) | $V_2O_5$ | $RuO_2$ | 21 | 4 | −1.8 |
| 2-(2) | $V_2O_5$ | $PtO_2$ | 19 | 3 | −1.8 |
| 2-(3) | $V_2O_5$ | $IrO_2$ | 15 | 6 | −1.5 |
| 2-(4) | $V_2O_5$ | $RhO_2$ | 20 | 6 | −1.7 |

*1The vapor-deposition source is a mixed-target prepared by mixing the second material to the first material ($V_2O_5$) in an amount of 25% by mole on the basis of the first material The temperature of the silicon substrate in forming the film of the temperature-measuring-resistor was regulated to 200° C., the sputtering power to 100 W, and the atmosphere gas pressure to 1 Pa. Under these conditions, a film of the temperature-measuring-resistor having a thickness of about 1,000 Å was formed in about 20 minutes. The formed film was one wherein the metal oxide (ruthenium oxide, platinum oxide, iridium oxide or rhodium oxide) shown in Table 2 is contained in an oxide of a mixture of pentavanadium and tetravanadium.

Percentage (%) of the number of metal atoms derived from the electrically conductive material to the total metal atoms in the film of the temperature-measuring-resistor was measured by the same apparatus as in Example 1. The results are shown in Table 2.

EXAMPLE 3

A film of a temperature-measuring-resistor was formed on a thermal-oxidized film (insulative film) on a silicon substrate by RF sputtering under a nitrogen gas atmosphere by using a multi-target of the first material shown in Table 3 and the second material shown in Table 3.

The temperature of the silicon substrate in forming the film of the temperature-measuring-resistor was regulated to that shown in Table 3, sputtering power of each target to 100 W and an atmosphere gas pressure to 1 Pa Under the above-mentioned conditions, a film of the temperature-measuring-resistor having a thickness of about 1,000 Å was formed in about 15 minutes. The film of the temperature-measuring-resistor was the vanadium oxide containing the metal and its nitride shown in Table 3 (titanium and titanium nitride, tantalum and tantalum nitride and niobium and niobium nitride).

Percentage (%) of the number of metal atoms derived from the electrically conductive material to the total metal atoms in the temperature-measuring-resistor was measured in the same manner as in Example 1. The results are shown in Table 3.

Also percentage (%) of the number of nitrogen atoms to the sum of nitrogen atoms and oxygen atoms in the film of the temperature-measuring-resistor was measured by Auger electron spectrometer (AES) (Model 650 available from Ulvac phi). The results are shown in Table 3.

Then the same gold electrodes as in Example 1 were provided on the film of the temperature-measuring-resistor formed on the thermal-oxidized film on the silicon substrate, and the volume resistivity at 27° C. and TCR at 27° C. were evaluated by the four-terminal method in the same manner as in Example 1. The results are shown in Table 3.

TABLE 3

| Experimental Example | Vapor-deposition source*1 First material | Vapor-deposition source*1 Second material | Substrate temperature (°C.) | Percentage of the number of metal atoms derived from the electrically conductive material to the total metal atoms in the temperature-measuring-resistor (%) | Percentage of nitrogen atoms to the sum of nitrogen atoms and oxygen atoms in the temperature-measuring-resistor (%) | Volume resistivity (mΩ · m) | TCR (%/K) |
|---|---|---|---|---|---|---|---|
| 3-(1) | $V_2O_5$ | Ti | 200 | 38 | 24 | 0.8 | −1.6 |
| 3-(2) | $V_2O_5$ | Ta | 300 | 35 | 25 | 2.3 | −1.8 |
| 3-(3) | $V_2O_5$ | Nb | 300 | 36 | 23 | 2.1 | −1.8 |

*1Multi-target

*2(The number of nitrogen atoms/the number of nitrogen atoms + oxygen atoms) × 100 (%)

It is preferable that the above-mentioned percentage (%) of the number of nitrogen atoms to the sum of nitrogen atoms and oxygen atoms is within the range of 5 to 52%. In the case where the percentage is within the above-mentioned range, there can be obtained stably the temperature-measuring-resistor having a volume resistivity of not more than 20 mΩ·m and an absolute value of the TCR of more than 0.7%/K When the percentage is more than 52%, though the volume resistivity of the temperature-measuring-resistor is maintained at 20 mΩ·m or less, the absolute value of the TCR is lowered to not more than 0.7%/K and from the viewpoint of TCR, the obtained temperature-measuring-resistor becomes not advantageous as compared with the other material having the same volume resistivity. On the contrary, when the percentage is not more than 1%, it is not preferable because the volume resistivity of the temperature-measuring-resistor exceeds 20 mΩ·m, and in case where the percentage is more than 1% and less than 5%, it is not preferable because characteristics of the temperature-measuring-resistors in every batch-wise production differs greatly and the yield is lowered.

EXAMPLE 4

A film of a temperature-measuring-resistor was formed on a thermal-oxidized film (insulative film) on a silicon substrate by RF magnetron sputtering under a mixed gas atmosphere of argon gas and nitrogen gas by using divanadium pentoxide ($V_2O_5$) as the first material and vanadium nitride (VN) as the second material.

The temperature of the above-mentioned silicon substrate in forming the film of the temperature-measuring-resistor was 300° C., the sputtering power to each target was adjusted to the values shown in Table 4. The argon gas/nitrogen gas ratio of the mixed gas is shown in Table 4, and the atmosphere gas pressure was 1 Pa. Under these conditions, a film of the temperature-measuring-resistor of the vanadium oxide containing nitrogen atoms and having a thickness of about 1,000 Å was formed in about 25 minutes.

The ratio of the number of nitrogen atoms to the sum of the nitrogen atoms and the oxygen atoms in the temperature-measuring-resistor, volume resistivity measured at 27° C. in the same manner as in Example 1 and TCR at 27° C. of the obtained temperature-measuring-resistor are shown in Table 4.

TABLE 4

| Experimental Example | Argon gas/nitrogen gas ratio in mixed gas*1 | Sputtering power (W) | Percentage of the number sum of nitrogen atoms and oxygen atoms in the temperature-measuring-resistor (%)*2 | Volume resistivity (mΩ · m) | TCR (%/K) |
|---|---|---|---|---|---|
| 4-(1) | 100:0 | $V_2O_5$:100 VN:0 | 0 | 24.6 | −1.8 |
| 4-(2) | 90:10 | $V_2O_5$:100 VN:25 | 0.4 | 19.2 | −1.8 |
| 4-(3) | 70:30 | $V_2O_5$:100 VN:50 | 5.3 | 1.6 | −2.0 |
| 4-(4) | 50:50 | $V_2O_5$:100 VN:100 | 42 | 0.1 | −1.2 |

TABLE 4-continued

| Experimental Example | Argon gas/ nitrogen gas ratio in mixed gas*1 | Sputtering power (W) | Percentage of the number sum of nitrogen atoms and oxygen atoms in the temperature-measuring-resistor (%)*2 | Volume resistivity (mΩ · m) | TCR (%/K) |
|---|---|---|---|---|---|
| 4-(5) | 50:50 | $V_2O_5$:25 VN:150 | 67 | 0.04 | −0.8 |
| 4-(6) | 0:100 | $V_2O_5$:0 VN:100 | 100 | 0.005 | 0.3 |

*1Volume ratio
*2(The number of nitrogen atoms/the number of nitrogen atoms + oxygen atoms) × 100 (%)

EXAMPLE 5

A film of a temperature-measuring-resistor was formed on a thermal-oxidized film (insulative film) on a silicon substrate by an RF sputtering under nitrogen gas atmosphere by using a multi-target of divanadium pentoxide as the first material and titanium nitride as the second material.

The temperature of the above-mentioned silicon substrate in forming a film of the temperature-measuring-resistor was 400° C., the sputtering power to the target was 100 W, and the atmosphere gas pressure was 1 Pa. Under these conditions, a film of the temperature-measuring-resistor having a thickness of about 800 Å was formed in about 15 minutes.

The same gold electrode for measuring as in Example 1 was provided on the film of the temperature-measuring-resistor formed on the above-mentioned silicon substrate with a thermal-oxidized film. The volume resistivity and TCR were estimated in the same manner as in Example 1 through the four-terminal method. This temperature-measuring-resistor is the vanadium oxide containing titanium nitride, and titanium nitride functions as the electrically conductive material.

The percentage (%) of the metal atoms derived from the electrically conductive material to the total metal atoms in the film of the temperature-measuring-resistor, which was measured in the same manner as in Example 1, was 7%. Also the ratio of the number of nitrogen atoms to the sum of the nitrogen atoms and the oxygen atoms in the temperature-measuring-resistor was measured in the same manner as in Example 3, and it was 3.3%. Also, the volume resistivity measured at 27° C. in the same manner as in Example 1 was 15 mΩ·m, and the TCR at 27° C. was −1.6%/K

EXAMPLE 6

A film of a temperature-measuring-resistor was formed on a thermal-oxidized film (insulative film) on a silicon substrate by RF reactive sputtering under a mixed gas atmosphere of the nitrogen gas and oxygen gas by using vanadium as a target.

The temperature of the above-mentioned silicon substrate in forming a film of the temperature-measuring-resistor was 400° C. and the sputtering power was 100 W. The nitrogen/oxygen gas ratio of the mixed gas for forming the film of the temperature-measuring-resistor is shown in Table 5, and the atmosphere gas pressure was 1 Pa. Under these conditions, a film of the temperature-measuring-resistor of the vanadium compound containing vanadium, nitrogen and oxygen and having a thickness of about 1,000 Å was formed in about 20 minutes.

An average valency of vanadium atoms in the above-mentioned temperature-measuring-resistor was evaluated by X-ray photoelectron spectrometer (XPS) (HB50A) available from VG Co., Ltd. The average valency of the vanadium atoms in the temperature-measuring-resistor was estimated by using the obtained area ratio of respective bonding peaks. The results are shown in Table 5.

Also the ratio of the number of nitrogen atoms to the sum of the nitrogen atoms and the oxygen atoms in the temperature-measuring-resistor was measured in the same manner as in Example 3. The results are shown in Table 5.

The same gold electrode for measuring as in Example 1 was provided on the film of the temperature-measuring-resistor formed on the above-mentioned silicon substrate. A volume resistivity at 27° C. and a TCR at 27° C. were measured in the same manner as in Example 1. The results are shown in Table 5.

TABLE 5

| Experimental Example | $N_2$:$O_2$ ratio in mixed gas*1 | Average valency of vanadium atoms | Percentage of the number of nitrogen atoms to the sum of nitrogen atoms and oxygen atoms in the temperature-measuring-resistor (%)*2 | Volume resistivity (mΩ · m) | TCR (%/K) |
|---|---|---|---|---|---|
| 6-(1) | 20:0.1 | 4.1 | 57 | 0.002 | −0.2 |
| 6-(2) | 20:1 | 4.2 | 52 | 0.005 | −0.7 |
| 6-(3) | 20:3 | 4.6 | 14 | 0.15 | −2.3 |
| 6-(4) | 20:7 | 4.8 | 16 | 7.6 | −1.9 |
| 6-(5) | 20:8 | 4.9 | 5 | 17 | −1.8 |
| 6-(6) | 20:10 | 4.95 | 3 | 300 | −1.6 |

*1Volume ratio
*2(The number of nitrogen atoms/the number of nitrogen atoms + oxygen atoms) × 100 (%)

EXAMPLE 7

A vanadium compound containing vanadium, nitrogen and oxygen, which has a thickness of about 1,000 Å, a volume resistivity of $2\times10^{-6}$ Ω·m at 27° C. and a TCR of −0.5%/K at 27° C., was formed on the substrate in the same manner as in Example 6 except that a volume ratio of nitrogen gas/oxygen gas in the gas atmosphere for forming the film was 20:0.5, followed by annealing of the resulting vanadium compound at 300° C. for two hours under the 100% oxygen gas atmosphere.

An average valency of vanadium atoms in the temperature-measuring-resistor, which was measured in the same manner as in Example 6, was 4.8. Percentage (%) of the number of nitrogen atoms to the sum of nitrogen atoms and oxygen atoms in the temperature-measuring-resistor, which was measured in the same manner as in Example 3, was 15%.

The same gold electrode for measuring as in Example 1 was provided on the film of the temperature-measuring-resistor formed on the thermal-oxidized film of the above-mentioned silicon substrate, and a volume resistivity at 27° C. and a TCR at 27° C. were measured in the same manner as in Example 1. The volume resistivity at 27° C. was 2 mΩ·m, and the TCR was −1.9%/K.

EXAMPLE 8

A film of a temperature-measuring-resistor was formed on a thermal-oxidized film on a silicon substrate by reactive RF magnetron sputtering under a mixed gas atmosphere of the nitrogen gas and the oxygen gas shown in Table 6 by using vanadium as a target.

The temperature of the above-mentioned silicon substrate in forming a film of the temperature-measuring-resistor was regulated to 350° C., and the sputtering power to 100 W. Also, the mixing ratios of the nitrogen gas to the oxygen gas were adjusted to the values shown in Table 6, and the atmosphere gas pressure was 1 Pa. Under those conditions, a film of the temperature-measuring-resistor of a vanadium compound containing vanadium, nitrogen and oxygen and having a thickness of about 1,000 Å was formed in 30 minutes. The average valency of vanadium atoms in the obtained temperature-measuring-resistor was measured in the same manner as in Example 6. Also, the percentage of the number of nitrogen atoms to the sum of nitrogen atoms and oxygen atoms in the obtained temperature-measuring-resistor (nitrogen content) was measured in the same manner as in Example 3. The results of the respective measurements are shown in Table 6.

The same gold electrode for measuring as in Example 1 was provided on the film of the temperature-measuring-resistor formed on the thermal-oxidized film of the above-mentioned silicon substrate, and a volume resistivity at 27° C. and a TCR at 27° C. were measured in the same manner as in Example 1.

The results are shown in Table 6.

TABLE 6

| Experimental Example | $N_2$:$O_2$ ratio in mixed gas*1 | Average valency of vanadium atoms | Percentage of the number of nitrogen atoms to the sum of nitrogen atoms and oxygen atoms in the temperature-measuring-resistor (%)*2 | Volume resistivity (mΩ · m) | TCR (%/K) |
|---|---|---|---|---|---|
| 8-(1) | 20:1 | 4.6 | 3.7 | 0.4 | −3.5 |
| 8-(2) | 20:2 | 4.6 | 0.3 | 1.6 | −2.7 |
| 8-(3) | 20:3 | 4.7 | 0.2 | 3.1 | −1.8 |

*1Volume ratio

*2(The number of nitrogen atoms/the number of nitrogen atoms + oxygen atoms) × 100 (%)

EXAMPLE 9

A film of a temperature-measuring-resistor was formed on a thermal-oxidized film (insulative film) on a silicon substrate by reactive RF sputtering under a mixed gas atmosphere of nitrogen gas and oxygen gas by using a multi-target of vanadium and platinum. The obtained temperature-measuring-resistor corresponds to the one which comprises a vanadium compound containing vanadium, oxygen and nitrogen and an electrically conductive material comprising at least one member selected from the group consisting of a metal, metal oxide and metal nitride and having electric conductivity higher than that of the vanadium compound.

The temperature of the silicon substrate in forming the film of the temperature-measuring-resistor was regulated to 400° C., the sputtering power to the vanadium target and the platinum target to 100 W and 50 W, respectively, the atmosphere gas pressure to 1 Pa, and the mixing ratio of the nitrogen gas to the oxygen gas to 20:7. Under those conditions, an about 900 Å thick film of the temperature-measuring-resistor was formed in about 30 minutes.

The percentage (%) of the number of metal atoms (platinum) derived from the electrically conductive material to the total metal atoms in the film of the temperature-measuring-resistor, which was measured in the same manner as in Example 1, was 18%.

Subsequently, the same gold electrodes for measuring as in Example 1 was provided on the film formed on the thermal-oxidized film on the silicon substrate, and the volume resistivity at 27° C. and the TCR at 27° C. were evaluated in the same manner as in Example 1. As a result, the volume resistivity at 27° C. was 11 mΩ·m, and the TCR at 27° C. was −1.2%/K.

EXAMPLE 10

A temperature measuring device having a construction as shown in a plan view FIG. 1(*a*) and a cross-sectional view 1(*b*) of a line A—A of FIG. 1(*a*), was manufactured. Namely, an insulative film 2 (film thickness 2,000 Å) of silicon oxide ($SiO_2$) was formed, by chemical vapor-deposition (CVD), on the same level as a transistor circuit 7 and a signal processing circuit 6 for a temperature measuring element, which were formed on one side of a silicon substrate 1. Subsequently, a contact hole was formed on the insulative film by ion beam etching, and then a pair of platinum electrodes 3 and 4 were formed by the lifting-off method. Then the electrodes were electrically connected to the signal processing circuit 6, and the film of the temperature-measuring-resistor (film thickness 1,000 Å) having a volume resistivity of 7.6 mΩ·m at 27° C. and a TCR of −1.9%/K at 27° C. was formed in the same manner as in Experimental No. 6-(4) of Example 6 so as to cover the platinum electrodes and the insulative film. The temperature measuring device was manufactured by patterning of the temperature-measuring-resistor with 1N hydrochloric acid (Numeral 5 in FIG. 1 shows the temperature-measuring-resistor after patterning).

The temperature measuring device of an integrated temperature measuring element and signal processing circuit is provided on the same substrate as a temperature-measured portion, i.e. the transistor circuit and therefore a temperature of the transistor circuit can be measured highly accurately. This device can also be used as a thermo-switch, and in that case, the thermo-switch can be operated highly accurately to protect at an early stage of overheating.

EXAMPLE 11

An infrared-ray detecting device having a construction as shown in a plan view FIG. 2(*a*) and a cross-sectional view 2(*b*) of a line B—B of FIG. 2(*a*) was manufactured. That is, a support film 9 of silicon nitride (SiN) (film thickness 2,000 Å) was formed on one side of a silicon substrate 8 by CVD and a pair of platinum electrodes 11 and 12 were formed on the support film by the lifting-off method. Then, a temperature-measuring-resistor (film thickness 1,000 Å) having a volume resistivity of 7.6 mΩ·m at 27° C. and a TCR of −1.9%/K at 27° C. was formed in the same manner as in Experimental No. 6-(4) of Example 6 so as to cover the support film and the electrodes. After patterning of the above-mentioned temperature-measuring-resistor with 1N hydrochloric acid (Numeral 13 in FIG. 2 shows the temperature-measuring-resistor after being subjected to patterning), a protective layer 15 of silicon nitride (SiN) (in a plan view of FIG. 2(*a*), this protective film is not shown, but is formed all over the surface excepting etching hole portions) (film thickness 2,000 Å) was formed so as to cover the support film, electrodes and temperature-measuring-resistor. Afterwards, an etching hole 10 was formed by ion beam etching and then the etching was carried out with 30% by weight of an aqueous potassium hydroxide solution of 70° C. to form a cavity 14 under the temperature-measuring-resistor, which is connected to the etching hole 10. Thus an infrared-ray detecting device was manufactured.

The above-mentioned infrared-ray detecting device is provided with the temperature-measuring-resistor of the present invention as the infrared-ray detecting portion and the temperature-measuring-resistor has a low volume resistivity. Even if the temperature-measuring-resistor is made thin in the form of a film in order to enable a temperature of the detecting portion to be fully variable even with small heating value, resistance of the detecting portion can be decreased and the area for the electrodes of the infrared-ray detecting element can be reduced.

Since an incident infrared ray is reflected at an electrode portion, reduction of the area for the electrodes is very effective for highly efficiently detecting incident infrared rays. In Example of the present invention, the area for the electrodes could be reduced to about ¼ of that of the conventional infrared-ray detecting device, that is to say, a reflection loss of infrared ray at the electrode portion could be decreased to about ¼.

EXAMPLE 12

An infrared-ray detecting device so constructed as shown in a plan view FIG. 5(*a*) and a cross-sectional view FIG. 5(*b*) (cross-sectional view of a line D—D of FIG. 5(*a*)) was manufactured, namely, a support (insulative) film 50 (thickness: 2,000 Å) of silicon nitride (SiN) was formed through CVD on one side of a silicon substrate 54 where a signal processing circuit 56 for the infrared-ray detecting device is provided on the same side as the support film. Then contact holes were formed in the above-mentioned support film through ion beam etching. Subsequently, a pair of electrodes and lines 52 were formed by using platinum through lifting-off method in such a manner as to embed the contact holes, and then electrically connected to the signal processing circuit 56. Afterwards, a temperature-measuring-resistor (thickness: 1,000 Å) having a volume resistivity of 7.6 mΩ·m at 27° C. and a TCR of −1.9%/K at 27° C. was provided in the same manner as in Experimental No. 6-(4) of Example 6 so as to cover the insulative film 50 and electrodes and lines 52, and then was subjected to patterning with 1N hydrochloric acid. Furthermore, etching holes 51 were formed in the insulative film of silicon nitride through ion beam etching with 30% by weight of aqueous potassium hydroxide solution of 70° C., and thereby a cavity 55 directly connected to the etching holes 51 was formed under a detecting portion comprising the temperature-measuring-resistor 53, the support film 50, and the electrodes and lines 52 to give an infrared-ray detecting device being integrated with the signal processing circuit. In FIG. 5(*b*), numeral 57 is a protective film.

According to that infrared-ray detecting device, since the volume resistivity of the temperature-measuring-resistor is low as compared with conventional materials, it is possible for the temperature measuring element having a thinner film thickness to assure the same resistance as that of the conventional element. Therefore, low heat capacity of the detecting portion is realized and thus with transmission of the same amount of heat value (amount of infrared rays), a larger increase in temperature at the detecting portion and enhancement of sensitivity were achieved.

EXAMPLE 13

Figure 6A:
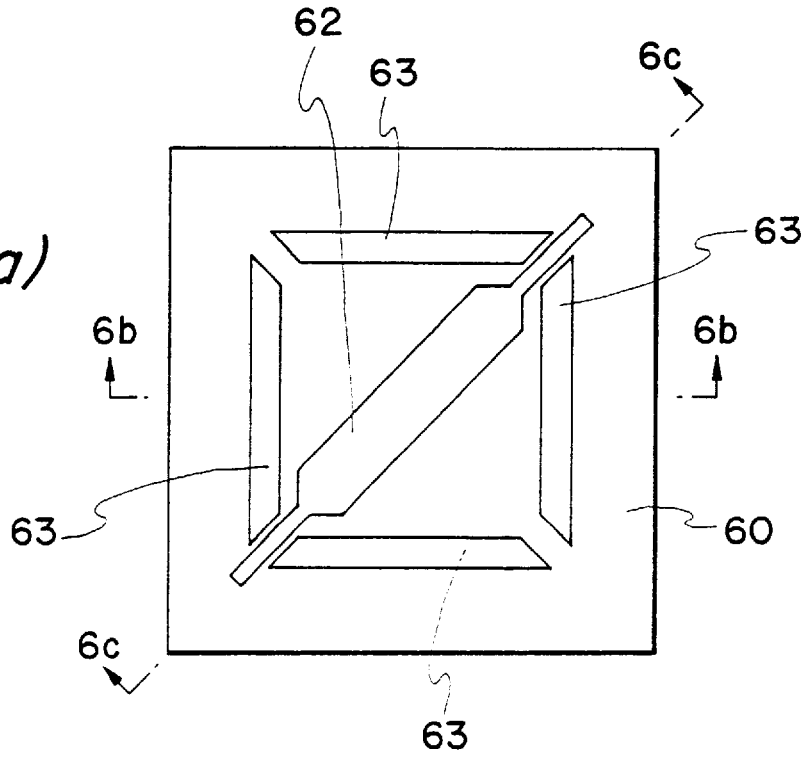
FIG. 6(*a*) is a plan view showing an infrared-ray detecting element of Example 13 and FIGS. 6(*b*) and 6(*c*) are cross-sectional views of lines F—F and G—G of FIG. 6(*a*), respectively.
Figure 6B:
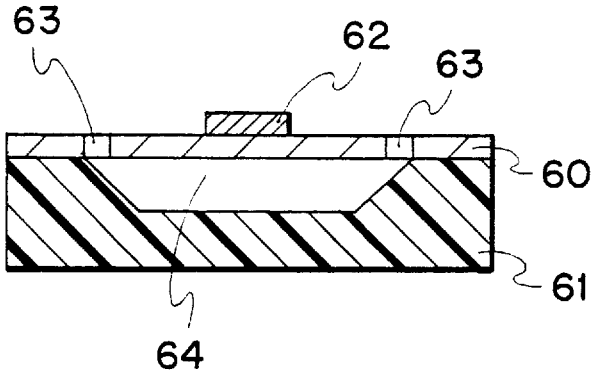
Figure 6C:
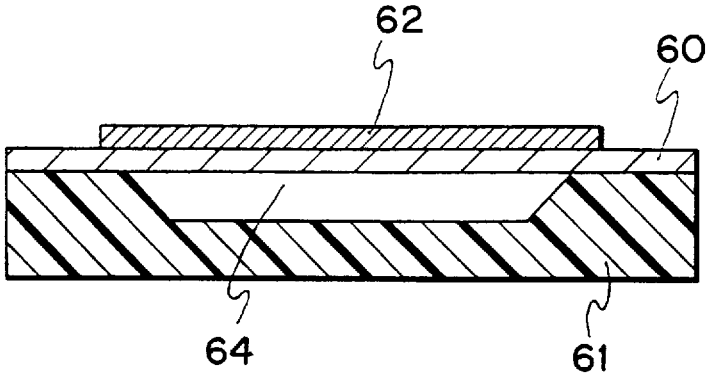

An infrared-ray detecting device having a construction as shown in a plan view of FIG. 6(*a*) and cross-sectional views FIG. 6(*b*) (cross-sectional view of a line F—F of FIG. 6(*a*)) and 6(*c*) (cross-sectional view of a line G—G of FIG. 6(*a*)) was manufactured. Namely, a support film 60 (thickness: 2,000 Å) of silicon nitride (SiN) was formed on one surface of a silicon substrate 61 through CVD. On the support film 60 is formed a temperature-measuring-resistor (thickness: 1,000 Å) having a volume resistivity of 0.15 mΩ·m at 27° C. and a TCR of −2.3%/K at 27° C. in the same manner as in Experimental No. 6-(3) of Example 6. That temperature-measuring-resistor was subjected to patterning with 1N hydrochloric acid. Then etching holes 63 were made in the support film of the silicon nitride through ion beam etching with 30% by weight of aqueous potassium hydroxide solution of 70° C., and thereby a cavity 64 directly connected to the etching holes 63 under a detecting portion comprising the temperature-measuring-resistor 62 and the support film 60 to give an infrared-ray detecting device. The infrared-ray detecting device so constructed could enhance a coefficient of infrared absorption by 5% as compared with an infrared-ray detecting device comprising an element using electrodes (for example, shown in FIG. 5).

What is claimed is:

1. A temperature-measuring-resistor comprising vanadium oxide as a matrix material, wherein the matrix material comprises at least one member selected from the group consisting of a metal, a metal oxide, and a metal nitride, wherein said metal comprises at least one metal selected from the group consisting of platinum, iridium, rhodium and gold, wherein said metal oxide comprises at least one metal oxide selected from the group consisting of a ruthenium oxide, a platinum oxide, an iridium oxide, a rhodium oxide, a rhenium oxide, an osmium oxide, a tungsten oxide, a molybdenum oxide, a tin oxide, and a titanium oxide, and wherein said member has an electric conductivity higher than that of said vanadium oxide.

2. The temperature-measuring-resistor of claim 1, wherein said member comrises said metal and said metal comprises at least one metal selected from the group consisting of platinum, iridium and rhodium.

3. The temperature-measuring-resistor of claim 1, wherein said member comprises said metal oxide and said metal oxide comprises at least one metal oxide selected from the group consisting a ruthenium oxide, a platinum oxide, an iridium oxide and a rhodium oxide.

4. The temperature-measuring-resistor of claim 1, wherein said member comprises said metal nitride, and said metal nitride comprises at least one metal selected from the group consisting of a titanium nitride, a niobium nitride and a tantalum nitride.

5. The temperature-measuring-resistor of claim 1, wherein the number of metal atoms derived from said electrically conductive material is in the range of 5 to 70% of the total number of metal atoms in the temperature-measuring-resistor.

6. The temperature-measuring-resistor of claim 1, wherein said metal nitride comprises vanadium nitride.

7. The temperature-measuring-resistor of claim 6, wherein a ratio of the number of nitrogen atoms to the sum of nitrogen atoms and oxygen atoms in said vanadium oxide which contains vanadium nitride is X, the ratio X is in the range shown by the equation:

$$0<X\leqq 0.67.$$

8. A method of manufacturing a temperature-measuring-resistor comprising vanadium oxide as a matrix material, wherein the matrix material comprises at least one member selected from the group consisting of a metal, a metal oxide, and a metal nitride, wherein said metal is platinum, iridium, rhodium or gold, wherein said metal oxide is ruthenium oxide, a platinum oxide, an iridium oxide, a rhodium oxide, a rhenium oxide, an osmium oxide, a tungsten oxide, a molybdenum oxide, a tin oxide, or a titanium oxide, and wherein said member has an electric conductivity higher than that of said vanadium oxide; the method comprises a step of vapor-deposition under a gas atmosphere by using, as vapor deposition sources, a first material for forming vanadium oxide and a second material for forming at least one member selected from the group consisting of the metal, the metal oxide and the metal nitride.

9. The method of manufacturing the temperature-measuring-resistor of claim 8, wherein the first material is vanadium oxide, the second material is the metal and/or metal oxide, said gas atmosphere is an inert gas atmosphere and the vapor-deposition is physical vapor-deposition.

10. The method of manufacturing the temperature-measuring-resistor of claim 8, wherein the first material is vanadium oxide, the secon d material is a metal and/or metal nitride, said gas atmosphere is a gas atmosphere containing a nitriding gas and the vapor-deposition is reactive physical vapor-deposition.

11. A device comprising a temperature-measuring-resistor which includes a vanadium compound comprising vanadium, oxygen and nitrogen.

12. The device of claim 11, wherein a ratio of the number of nitrogen atoms to the sum of the nitrogen atoms and oxygen atoms in said vanadium compound is represented by Y, the ratio Y is in the range shown by the equation:

$$0<Y\leqq 0.52.$$

13. The device of claim 11, wherein an average valency of vanadium atoms in said vanadium compound is in the range of 4.2 to 4.9.

14. The device of claim 11, wherein said vanadium compound contains at least one member selected from the group consisting of a metal, a metal oxide and a metal nitride, said member has an electric conductivity higher than that of said vanadium compound.

15. A method of manufacturing a temperature-measuring-resistor comprising a vanadium compound which contains vanadium, oxygen and nitrogen, wherein the method comprises a step of reactive physical vapor-deposition under a gas atmosphere which contains a nitriding gas and may contain an oxidizing gas, by using, as a vapor-deposition source, a material containing at least one of vanadium or vanadium oxide.

16. The method of manufacturing the temperature-measuring-resistor of claim 15, wherein said vanadium compound is annealed in an oxidizing gas atmosphere.

17. An infrared-ray detecting element which comprises an insulative support film, a pair of electrodes formed thereon, and a temperature-measuring-resistor connected to the electrodes, said temperature-measuring-resistor comprises vanadium oxide as a matrix material, wherein the matrix material contains at least one member selected from the group consisting of a metal, a metal oxide and a metal nitride, wherein said metal is platinum, iridium, rhodium or gold, wherein said metal oxide is a ruthenium oxide, a platinum oxide, an iridium oxide, a rhodium oxide, a rhenium oxide, an osmium oxide, a tungsten oxide, a molybdenum oxide, a tin oxide, or a titanium oxide, and wherein said member has an electric conductivity higher than that of said vanadium oxide.

18. The infrared-ray detecting element of claim 17, wherein the pair of electrodes comprises a material comprising vanadium oxide as a matrix material, wherein the matrix material contains at least one member selected from the group consisting of the metal, the metal oxide and the metal nitride, said member has an electric conductivity higher than that of said vanadium oxide.

19. An infrared-ray detecting element which comprises an insulative support film, a pair of electrodes formed thereon and a temperature-measuring-resistor connected to the electrodes, said temperature-measuring-resistor comprises a vanadium compound containing vanadium, oxygen and nitrogen.

20. The infrared-ray detecting element of claim 19, wherein the pair of electrodes comprises a vanadium compound containing vanadium, oxygen and nitrogen.

21. The infrared-ray detecting element of claim 19, wherein a ratio of the number of nitrogen atoms to the sum of oxygen atoms and nitrogen atoms in the vanadium compound is represented by Y, said ratio Y is in the range shown by the equation:

$$0<Y\leqq 0.52.$$

22. The infrared-ray detecting element of claim 19, wherein an average valency of vanadium atoms in said vanadium compound is in the range of 4.2 to 4.9.

* * * * *

UNITED STATES PATENT AND TRADEMARK OFFICE

CERTIFICATE OF CORRECTION

PATENT NO. : 5,805,049

DATED : September 8, 1998

INVENTOR(S) : YAMADA, et al.

It is certified that error appears in the above-indentified patent and that said Letters Patent is hereby corrected as shown below:

On the title page, item [54], and Col. 1, lines 1-4:

Title is changed to read:

TEMPERATURE-MEASURING-RESISTOR,
MANUFACTURING METHOD THEREFOR,
AND INFRARED - RAY DETECTING
ELEMENT USING THE SAME

Signed and Sealed this

First Day of June, 1999

*Attest:*

*Attesting Officer*

Q. TODD DICKINSON

*Acting Commissioner of Patents and Trademarks*